US008453901B2

(12) United States Patent
Suda

(10) Patent No.: US 8,453,901 B2
(45) **Date of Patent: *Jun. 4, 2013**

(54) ELECTRIC DRIVE TOOL

(75) Inventor: Hidekazu Suda, Anjo (JP)

(73) Assignee: Makita Corporation, Anjo-Shi (JP)

( * ) Notice: Subject to any disclaimer, the term of this patent is extended or adjusted under 35 U.S.C. 154(b) by 168 days.

This patent is subject to a terminal disclaimer.

(21) Appl. No.: 12/452,289

(22) PCT Filed: Jun. 18, 2008

(86) PCT No.: PCT/JP2008/061131

§ 371 (c)(1),
(2), (4) Date: Jan. 11, 2010

(87) PCT Pub. No.: WO2009/001729

PCT Pub. Date: Dec. 31, 2008

(65) Prior Publication Data

US 2010/0116863 A1 May 13, 2010

(30) Foreign Application Priority Data

Jun. 28, 2007 (JP) ..... 2007-170213

(51) Int. Cl.
*B25C 1/06* (2006.01)

(52) U.S. Cl.
USPC ..... 227/8; 227/117; 227/133; 227/147

(58) Field of Classification Search
USPC ... 227/8, 129–134, 12, 2–7, 117, 147; 173/47
See application file for complete search history.

(56) References Cited

U.S. PATENT DOCUMENTS

| | | | | |
|---|---|---|---|---|
| 4,121,745 | A | 10/1978 | Smith et al. | |
| 4,129,240 | A * | 12/1978 | Geist | 227/8 |
| 4,189,080 | A | 2/1980 | Smith et al. | |
| 4,298,072 | A | 11/1981 | Baker et al. | |
| 4,323,127 | A | 4/1982 | Cunningham | |
| 4,679,719 | A | 7/1987 | Kramer | |
| 5,597,106 | A | 1/1997 | Hamano et al. | |
| 6,116,488 | A | 9/2000 | Lee | |
| 6,431,425 | B1 | 8/2002 | Moorman et al. | |
| 6,705,501 | B2 | 3/2004 | Miller et al. | |
| 7,137,541 | B2 | 11/2006 | Baskar et al. | |
| 7,204,322 | B2 * | 4/2007 | Sakai | 173/162.1 |
| 7,322,427 | B2 * | 1/2008 | Shimma et al. | 173/48 |

(Continued)

FOREIGN PATENT DOCUMENTS

| | | |
|---|---|---|
| GB | 2 284 377 A | 6/1995 |
| JP | A-07-237148 | 9/1995 |

(Continued)

OTHER PUBLICATIONS

International Search Report issued in International Application No. PCT/JP2008/061131; Mailed on Jul. 15, 2008.

(Continued)

*Primary Examiner* — Robert Long
(74) *Attorney, Agent, or Firm* — Oliff & Berridge, PLC

(57) ABSTRACT

The electric drive tool of the invention is configured such that a lock lever is provided to reliably prevent an erroneous operation of a trigger and an operating mode can be switched by changing an operational sequence of this lock lever and a contact trip.

9 Claims, 14 Drawing Sheets

U.S. PATENT DOCUMENTS

| | | | | |
|---|---|---|---|---|
| 7,445,139 | B2 | 11/2008 | Okouchi | |
| 7,458,492 | B2 | 12/2008 | Terrell et al. | |
| 8,167,183 | B2 * | 5/2012 | Matsunaga et al. | 227/8 |
| 8,191,648 | B2 * | 6/2012 | Watanabe et al. | 173/20 |
| 2001/0006183 | A1 | 7/2001 | Mukoyama et al. | |
| 2002/0104869 | A1 | 8/2002 | Garvis et al. | |
| 2002/0185514 | A1 | 12/2002 | Adams et al. | |
| 2005/0040206 | A1 * | 2/2005 | Adams et al. | 227/131 |
| 2005/0217875 | A1 | 10/2005 | Forster et al. | |
| 2006/0185865 | A1 * | 8/2006 | Jung et al. | 173/48 |
| 2008/0173139 | A1 * | 7/2008 | Miyazaki et al. | 81/57.11 |
| 2008/0257577 | A1 * | 10/2008 | Tanaka et al. | 173/4 |
| 2008/0257933 | A1 | 10/2008 | Takahashi et al. | |
| 2009/0120656 | A1 * | 5/2009 | Jung et al. | 173/48 |
| 2009/0321495 | A1 | 12/2009 | Hirabayashi et al. | |
| 2010/0038397 | A1 | 2/2010 | Krondorfer et al. | |
| 2010/0065294 | A1 | 3/2010 | Hirabayashi | |
| 2010/0116863 | A1 | 5/2010 | Suda | |
| 2010/0236800 | A1 * | 9/2010 | Watanabe et al. | 173/20 |
| 2010/0236801 | A1 * | 9/2010 | Furusawa et al. | 173/47 |
| 2011/0198381 | A1 * | 8/2011 | McCardle et al. | 227/8 |

FOREIGN PATENT DOCUMENTS

| | | |
|---|---|---|
| JP | A-08-090449 | 4/1996 |
| JP | A-10-230473 | 9/1998 |
| JP | A-2001-179656 | 7/2001 |
| JP | A-2004-536542 | 12/2004 |
| JP | A-2006-026858 | 2/2006 |
| JP | A-2006-130592 | 5/2006 |
| JP | A-2007-098560 | 4/2007 |
| JP | A-2007-136598 | 6/2007 |

OTHER PUBLICATIONS

Supplementary European Search Report completed Apr. 18, 2011 in European Application No. EP 08 77 7330.

May 27, 2011 Office Action issued in Russian Patent Application No. 2010102769 (with English-language translation).

Nov. 26, 2010 Office Action issued in U.S. Appl. No. 12/452,221.

May 24, 2011 Office Action issued in U.S. Appl. No. 12/452,221.

International Search Report for International Application No. PCT/JP2008/061130, issued Jul. 15, 2008.

Oct. 5, 2011 Notice of Allowance issued in U.S. Appl. No. 12/452,221.

* cited by examiner

| OPERATION SEQUENCE | | | | CONTROL MODE | | | | |
|---|---|---|---|---|---|---|---|---|
| | 1 | 2 | 3 | 1 | 2 | 3 | 4 | 5 |
| A | LL | CT | T | CONTINUOUS SHOT MODE | NON-OPERATING MODE | | SINGLE SHOT MODE | |
| B | LL | T | CT | | CONTINUOUS SHOT MODE (EFFECTIVE FOR ONLY ON/OFF OF CT) | | | |
| C | CT | LL | T | SINGLE SHOT MODE | | | | |
| D | T | (LL) | (CT) | NON-OPERATING MODE (ERROR MODE) | | | | |
| E | T | (CT) | (LL) | | | | | |
| F | CT | T | (LL) | | | | | |
| CONDITION FOR SWITCHING AN OPERATING MODE CONTINUOUS SHOT → SINGLE SHOT | | | | LL AND CT OFF (ALL OPERATIONS OFF) | CT OR T OFF | T OFF | CT OR T OFF | T OFF |
| CONDITION FOR SWITCHING AN OPERATING MODE SINGLE SHOT → CONTINUOUS SHOT | | | | | | CT AND T OFF | | CT AND T OFF |

LL : LOCK LEVER 30

CT : CONTACT TRIP 26

T : TRIGGER 4

SINGLE SHOT MODE : NEXT DRIVING CANNOT BE PERFORMED UNLESS RESETTING(TURNING OFF CT AND T) IS MADE

CONTINUOUS SHOT MODE : A DRIVING CAN BE PERFORMED EVERY TIME AN ON/OFF OPERATION OF CT(OR T) IS MADE

FIG. 12

ELECTRIC DRIVE TOOL

BACKGROUND OF THE INVENTION

1. Field of the Invention

The present invention relates to a drive tool for driving driven members, such as nails, into a driven material using an electric motor as a drive source.

2. Description of the Related Art

For example, a nail driving machine generally uses compressed air as a driving source, and a large striking power can be obtained by reciprocating a piston with the compressed air. In contrast, a tool has been proposed which strikes driven members, such as nails, by reciprocating a striking driver (a striking rod) with an electric motor as a driving source. Since driving the electric motor as the driving source with a direct current power source (a battery) makes connection of an air hose and a device such as a compressor in the case of an air system to become unnecessary, usability and handling property of the driven tools can be improved.

This electric drive tool has a basic configuration in which a drive wheel is rotated with the electric motor as the driving source, and a driver supporting base which supports the driver is strongly pressed against a peripheral surface of the drive wheel, so that a linear movement (a striking operation) in the direction of driving the driver is obtained.

As a technology relating to the electric drive tool, the one disclosed, for example, in U.S. Pat. No. 7,137,541 is publicly known in the related art. The technology disclosed in this Patent Document is configured to achieve a driving operation by getting the drive wheel to rotate in advance in a standby state by activating the electric motor at a moment when one of a first operation to press a contact trip against a driven material to move the same relatively upward and a second operation to pull a trigger-type switch lever (a trigger) with a finger tip is performed, and then by pressing the driver supporting base against the drive wheel at the timing when the other one is performed. According to this technology, activating the electric motor and getting the drive wheel to rotate in advance in a standby state by performing one of the first and the second operations causes a quick driving operation to be achieved at the timing when the other operation is performed.

However, according to the technology in the related art, since the configuration is such that the driving operation is performed by the pull operation of the trigger by the second operation in a state in which the contact trip is moved upward by the first operation, and the electric motor is started and the drive wheel starts to rotate in a standby state by the second operation before performing the first operation, it is preferable to include a third operation as a condition of starting the driving operation in view of prevention of an erroneous operation of the drive tool.

Further, in this kind of drive tool, a driving operation is performed one time when the first operation and the second operation are performed, and for performing a second driving operation and its subsequent driving operations there has been incorporated a continuous shot mode, in which continuous driving operations are performed by once performing an off-operation of the contact trip and by again performing an on-operation (first operation) while the trigger (second operation) is being pulled, and a single shot mode, in which a second driving operation cannot be performed unless off-operations of both the first operation and the second operation are once performed to reset to an initial state every time after the driving operation. Previously, one having a special switchable lever has been provided in order to switch between these operating modes, but a prompt mode switching cannot be performed owing to a troublesome switching operation.

Therefore, it is an object of the present invention to provide a drive tool that can reliably prevent an erroneous operation of the drive tool by allowing a driving operation only when a third operation is performed in addition to the first and second operation and that can realize a mode switching operation without troublesome operations of a lever as conventionally required.

SUMMARY OF THE INVENTION

According to a first aspect of the invention, it is necessary to release a locking mechanism (a third operation) in order to pull the trigger. Also, when performing the second operation before the first operation, releasing the locking mechanism is required by the third operation in advance.

Therefore, it is necessary to release the locking mechanism (the third operation) in advance in order to pull the trigger (the second operation), whereby it is ensured that an unintended operation of the drive tool can be prevented by preventing a mishandling of the trigger.

Further, according to the first aspect of the invention, an unintended operation of the trigger can be prevented and the locking mechanism can be effectively utilized to switch a operating mode, because an operating mode can be switched based on an operational sequence of the two operations, a contact trip operation and an unlock operation of the locking mechanism, not based on the conventional operation of the switching lever. According to this configuration, a driving is performed in a single shot mode when the contact trip is operated first and then an unlock operation of the locking mechanism is performed, and after that a pull operation of the trigger is performed. A driving is performed in a continuous mode when an unlock operation of the locking mechanism is performed and next the contact trip is operated, and after that a pull operation of the trigger is performed.

In abolishing a conventional switching lever, it may be possible that an operating mode could be switched based on an operational sequence of the contact trip and the trigger, but according to the drive tool as described in claim 1, prevention of an erroneous operation of the trigger and improvement in switching operability of operating modes can be both satisfied by configuring such that a locking mechanism is newly provided to prevent an erroneous operation of the trigger and an operating mode can be switched based on an operational sequence of an unlock operation of this locking mechanism and the contact trip.

According to a second aspect of the invention, an operating mode can be switched based on an operational sequence of the three operations, the contact trip, the trigger, and the locking mechanism. Therefore, the tool is configured such that an erroneous operation of the trigger can be prevented and the locking mechanism is effectively utilized to switch an operating mode.

According to a third aspect of the invention, without resetting all operations of the contact trip, trigger, and the locking mechanism, an operating mode can be switched by maintaining a state of either one operation and changing the other operational sequences.

According to another aspect of the invention, an unintended switching of operating modes during an operation can be prevented because an active operating mode is maintained unless at least an on-operation of the contact trip and a release operation of the locking mechanism are reset to return to an initial state. In this case, when the two operations, the first operation and the third operation, are reset, or when the first operation to the third operation are all reset to return to an initial state, an operating mode can be set again by a following operational sequence.

According to another aspect of the invention, a switching operation between a continuous mode and a single shot mode, which have been conventionally used in general, can be performed.

According to another aspect of the invention, an unintended driving operation can be prevented since an unintended operation can be controlled as an error mode.

BRIEF DESCRIPTION OF THE DRAWINGS

FIG. 4 is a front view of a trigger and a periphery of a lock lever. This figure shows a state in which the lock lever is unlocked and the trigger is turned ON.

FIG. 12 is a diagram showing operating modes in a list in a case in which the sequence of operation of the lock lever, the contact trip and the trigger is changed.

DETAILED DESCRIPTION OF THE INVENTION

Figure 1:
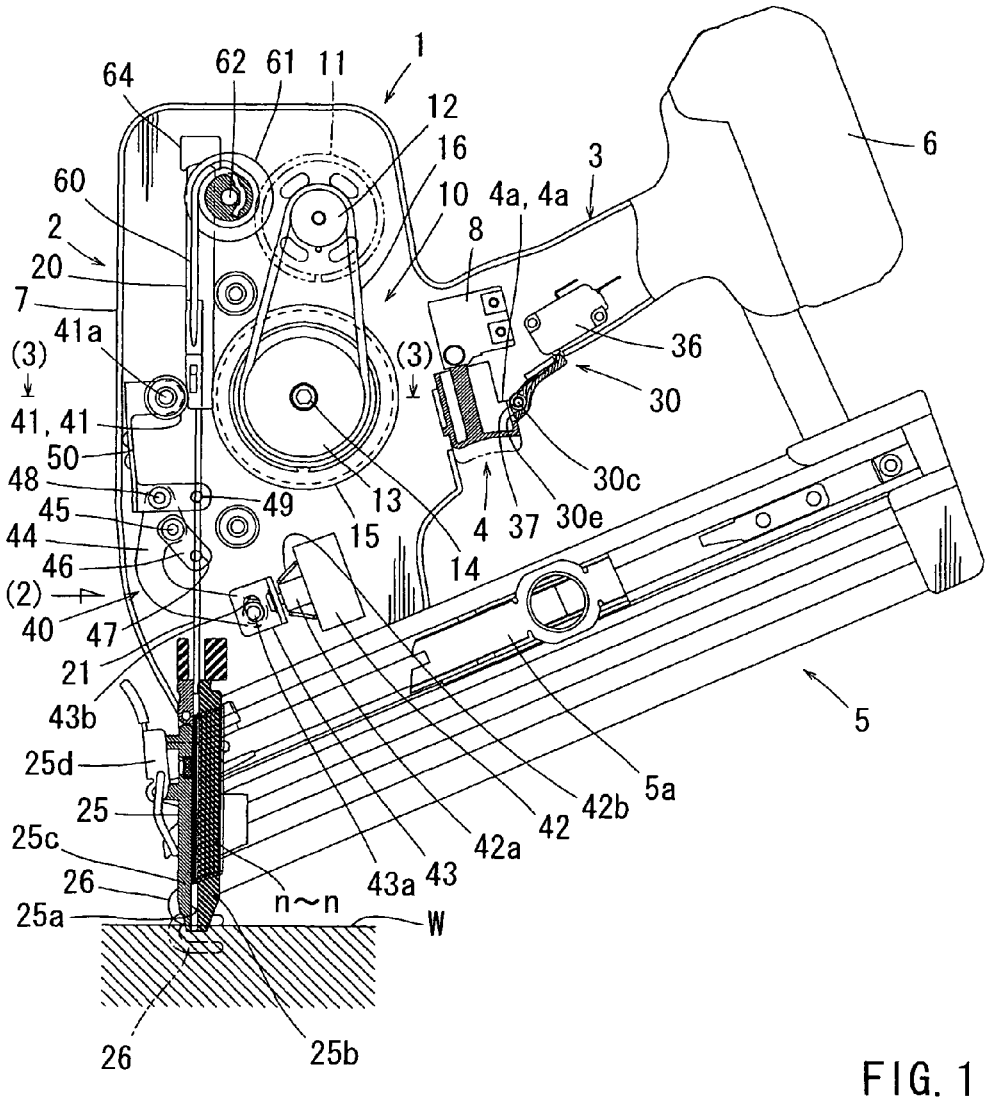
FIG. 1 is a general front view of an electric drive tool according to an embodiment of the present invention. This figure shows an internal structure of a driving mechanism and the like and an interior of a handle portion.
Figure 2:
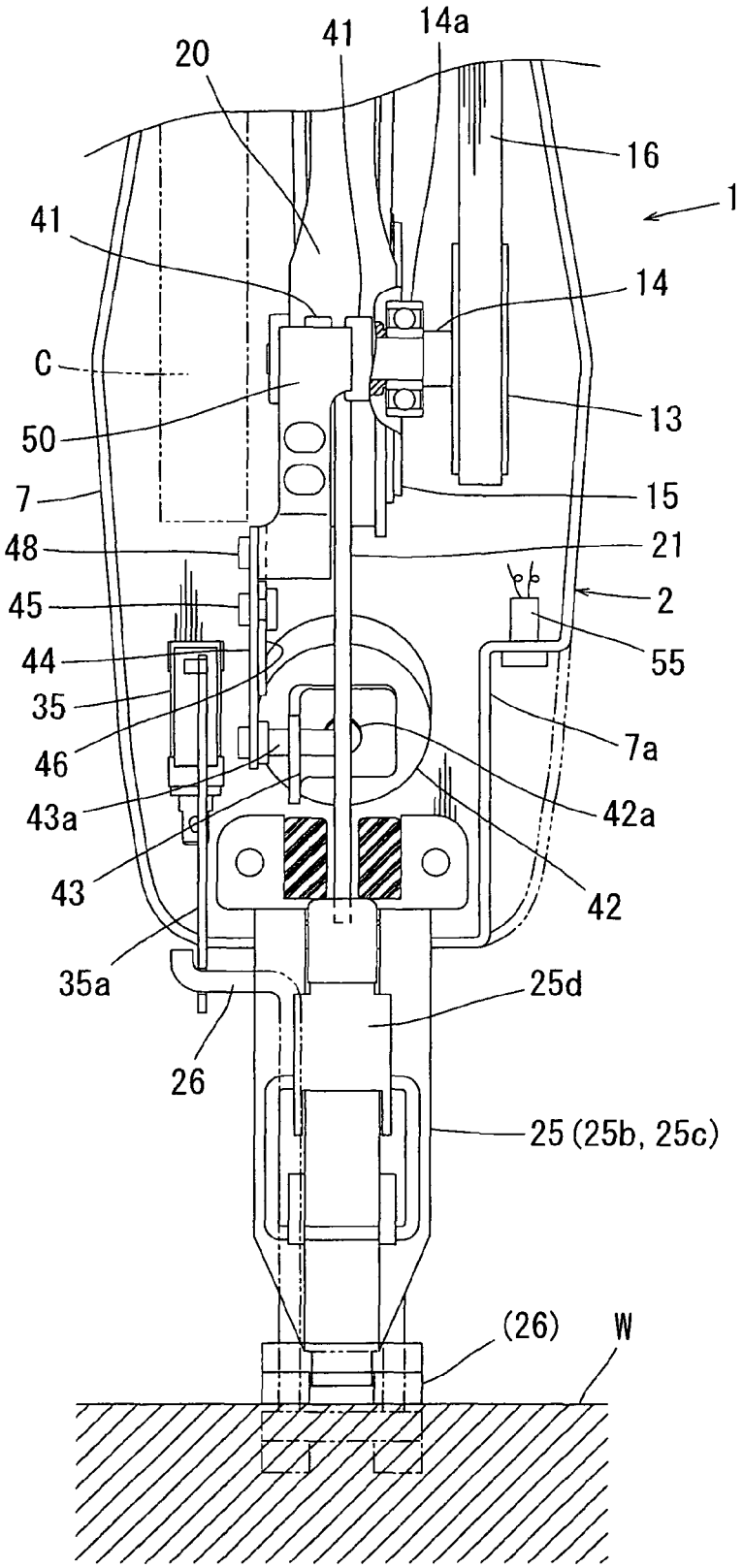
FIG. 2 is a back view of a body portion of the drive tool viewed in a direction indicated by an arrow (2) of FIG. 1.

Next, an embodiment of the present invention will be described with reference to FIGS. 1 to 17. FIG. 1 and FIG. 2 show a drive tool 1 according to this embodiment. The drive tool 1 includes a body portion 2, a handle portion 3, and a magazine 5.

The body portion 2 has a configuration including a driving mechanism 10 using an electric motor 11 as a driving source provided in the interior of a body housing 7 of a substantially cylindrical resin-made two-piece structure. One nail n is struck and driven into a driven material W by the driving mechanism 10. Detailed description of the driving mechanism 10 will be given later.

The handle portion 3 is provided integrally in a state of protruding laterally from a lateral part of the body portion 2. The handle portion 3 has a two-piece structure formed integrally with a lateral part of the body housing 7. The handle portion 3 includes a trigger 4 (a switch lever of a trigger type) and a lock lever 30 which are arranged at a base portion thereof. A rechargeable type battery pack 6 is mounted at a distal end of the handle portion 3. The electric motor 11 is started by the battery pack 6 as a power source.

The magazine 5 having a number of driven members (in this example, the nails n-n are exemplified) loaded therein is provided so as to extend between a distal end of the body portion 2 and the distal end of the handle portion 3. A number of relatively thin nails n-n, so-called finishing nails, are loaded in parallel to each other in the exemplified magazine 5. This magazine 5 is provided with a pushing plate 5*a* which is moved in a feeding direction (toward the left in FIG. 1) in conjunction with the driving operation of the body portion 2. The nail n is fed one by one to a driving position of the body portion 2 by the pushing plate 5*a*.

FIG. 1 shows a state in which a distal end portion of the body portion 2 is directed toward the driven material W. Therefore, in FIG. 1, the downward direction corresponds to the driving direction of the nail n. In the description given below, the direction along the driving direction is referred to as the vertical direction unless otherwise specified.

Figure 3:
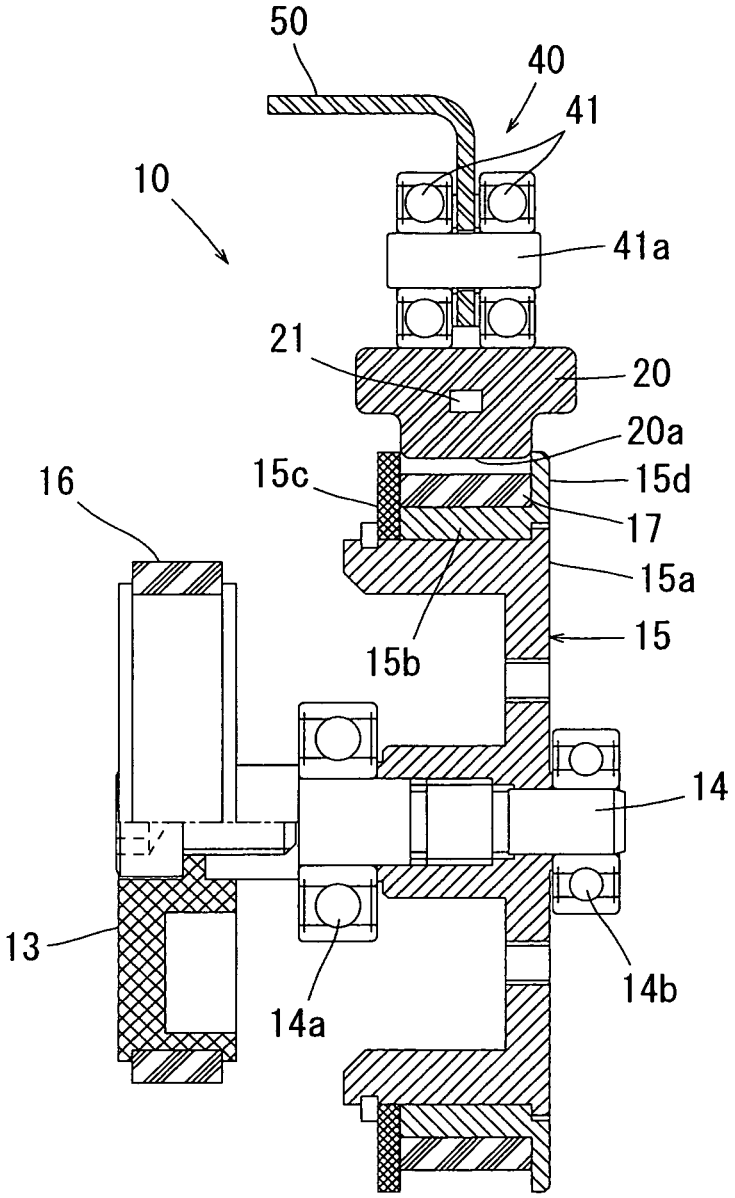
FIG. 3 is a cross-sectional view of a drive wheel and a periphery thereof taken along the line indicated by arrows (3)-(3) of FIG. 1.

The electric motor 11 as the driving source of the driving mechanism 10 is housed within a rear portion (an upper section in FIG. 1) of the body housing 7. A driving pulley 12 is attached to an output shaft of the electric motor 11. A driven pulley 13 is arranged substantially centrally in the body housing 7 in the longitudinal direction (the length direction of the tool, the vertical direction in FIG. 1) so as to correspond to the driving pulley 12. As shown in FIG. 3, the driven pulley 13 is attached to an end portion of a drive shaft 14 rotatably supported by the body housing 7 via bearings 14*a*, 14*b*. A drive wheel 15 is attached to the drive shaft 14 in addition to the driven pulley 13. The drive wheel 15 and the driven pulley 13 rotate coaxially and together via the drive shaft 14.

A driving belt 16 is put to extend between the driving pulley 12 and the driven pulley 13. The driven pulley 13 is rotated by the driving belt 16 when the driving pulley 12 is rotated by the activation of the electric motor 11, and hence the drive wheel 15 is rotated together via the drive shaft 14.

In the case of this example, the drive wheel 15 has a double structure including an inner wheel 15*a* and an outer wheel 15*b*. The outer wheel 15*b* is mounted on the outer peripheral side of the inner wheel 15*a* concentrically in a state of no play. The outer wheel 15*b* is mounted to the inner wheel 15*a* so as to be capable of relative displacement in the rotational direction. However, members for transmitting a rotational force are inserted between the inner wheel 15*a* and the outer wheel 15*b*, so that a rotational force of the electric motor 11 is transmitted from the inner wheel 15*a* to the outer wheel 15*b*. As members for transmitting the rotational force, fine and hard granular substances such as alumina powder or ceramics powder are used. According to the drive wheel 15 having the double structure as described above, an excessive rotational force at the time of starting the driving operation etc. can be absorbed by slippage between the wheels 15*a*,15*b* (the relative rotation), so that the durability of the drive tool 1 can be improved. On the other hand, it is ensured that an adequate rotational force is transmitted from the inner wheel 15*a* to the outer wheel 15*b* via the members for transmitting the rotational force.

Flange portions 15*c*, 15*d* are formed so as to protrude from both end portions of the outer wheel 15*b* in the width direction. Between the both flange portions 15*c*, 15*d*, a rubber ring 17 having a high coefficient of friction is attached on the entire circumference of an outer peripheral surface of the outer wheel 15*b*.

Next, as shown in FIG. 1, at substantially the center of the body housing 7, a driver supporting base 20 is provided so as to be movable along the driving direction by way of a slide supporting mechanism that is not shown. A driver 21 is attached to a distal end (in the lower side of FIG. 1) of the driver supporting base 20. The driver 21 is elongated toward a distal end (downward in FIG. 1).

The driver supporting base 20 is arranged to be movable in the direction of the tangent to the above-described drive wheel 15, and a lateral side portion (a right 1 side part in FIG. 1) thereof is positioned between the both flange portions 15*c*, 15*d* of the drive wheel 15. Also, the driver supporting base 20 moves between a state of being pressed against an outer peripheral surface of the drive wheel 15 and a state of being apart therefrom by a little distance by a pressing mechanism 40 described later. FIG. 3 shows a state in which the driver supporting base 20 is positioned apart from the rubber ring 17 at the outer peripheral surface of the drive wheel 15 (a state of stand-by operation of the drive wheel 15). In the stand-by operation state, in which the driver supporting base 20 is apart from the drive wheel 15 (the state shown in FIG. 3), the drive wheel 15 runs idle and the driving operation is not performed. In contrast, when the driver supporting base 20 is pressed against the peripheral surface (the rubber ring 17) of the drive wheel 15 with a strong force by the pressing mechanism 40, a rotative power of the drive wheel 15 is converted into a linear movement in the driving direction (downward in FIG. 1) and is transmitted to the driver supporting base 20, whereby striking and driving operations of the nail n by the driver 21 are performed.

The driver 21 extends downward from the driver supporting base 20 and a distal end portion thereof reaches inside a drive hole 25*a* of a driver guide 25 provided at a distal end of the body housing 7.

A distal end portion of the magazine 5 on a supply side is connected to the driver guide 25. The nails n-n loaded in the magazine 5 are pressed by the pushing plate 5*a*, and when the nail n in the drive hole 25*a* is driven out and the driver 21 is retracted upward, a nail n to be driven next is supplied inside the drive hole 25*a*.

Next, the pressing mechanism 40 includes an electromagnetic actuator 42 as a driving source. The electromagnetic actuator 42 is arranged in a front portion of the body housing 7. An output shaft 42*a* of the electromagnetic actuator 42 is biased toward a protruding side by a conical compression spring 42*b*. When a power is supplied to the electromagnetic actuator 42, the output shaft 42*a* moves to a retracting side against the compression spring 42*b*. When the supply of power is interrupted, the output shaft 42*a* is returned to the protruding side by the compression spring 42*b*. The supply of power to the actuator 42 can be made by a control unit C on the basis of the operation of the trigger 4 or the contact trip 26, which will be described later.

One end side of an operating arm 44 is connected to a distal end of the output shaft 42*a* of the electromagnetic actuator 42 via a bracket 43 so as to be capable of relative rotation. An elongated connecting hole 43*b* is formed in the bracket 43 in the orthogonal direction 1 to the extending and retracting directions of the output shaft 42*a*. The one end side of the operating arm 44 is connected to the bracket 43 via a connecting shaft 43*a* inserted into the connecting hole 43*b*. Therefore, the one end side of the operating arm 44 is connected to the bracket 43 in a state in which the center of rotation can be displaced within such a range that the one end can rotate via the connecting shaft 43*a* and allows the connecting shaft 43*a* defining the center of rotation to move within the connecting hole 43*b*.

The operating arm 44 is bent in an L-shaped way and extends in the rearward direction (upward in FIG. 1). One end side of a restraining arm 46 is rotatably connected to the other end side of the operating arm 44 via a first movable support shaft 45. The restraining arm 46 is rotatably supported by the body housing 7 via a fixed support shaft 47. Also, the other end side of the operating arm 44 is rotatably connected to a pressing arm 50 via a second movable support shaft 48. The pressing arm 50 is rotatably supported by the body housing 7 via a fixed support shaft 49. Two pressing rollers 41, 41 are rotatably supported on the side of a distal end with respect to rotation of the pressing arm 50 (the upper end side in FIG. 1) via a support shaft 41*a*.

According to the pressing mechanism 40 configured in this manner, in the stand-by state shown in FIG. 1 and FIG. 3, the supply of power to the electromagnetic actuator 42 is interrupted, and hence the output shaft 42*a* is returned to the protruding side by the compression spring 42*b*. In this stand-by state, since the base end side of the operating arm 44 (the connecting shaft 43*a* side) is displaced obliquely leftward and downward in FIG. 1, the restraining arm 46 is tilted counterclockwise about the fixed support shaft 47, whereby the pressing arm 50 is tilted counterclockwise about the fixed support shaft 49, causing the pressing rollers 41, 41 to be apart from a back surface of the driver supporting base 20 (a left side surface in FIG. 1) or not to press the driver supporting base 20 toward the side of the drive wheel 15. Therefore, in this state as shown in FIG. 3, the driver supporting base 20 does not contact with the rubber ring 17 of the drive wheel 15.

In contrast, although not shown, when the power is supplied to the electromagnetic actuator 42, the output shaft 42*a* is operated toward the retracting side against the compression spring 42*b*. Then, since a base end side of the operating arm 44 is displaced obliquely rightward and upward, the restraining arm 46 is tilted clockwise about the fixed support shaft 47, causing the pressing arm 50 to be tilted clockwise about the fixed support shaft 49 and the pressing rollers 41, 41 to be brought into a state of being pressed against the back surface of the driver supporting base 20. When the pressing rollers 41, 41 are pressed against the back surface, a transmitting portion 20*a* of the driver supporting base 20 is pressed against the rubber ring 17 of the drive wheel 15 with a strong force.

In addition, in this state, the positional relationship among the respective support shafts are set so that the fixed support shaft 47 of the restraining arm 46, the first movable support shaft 45 as a connecting point to the operating arm 44, and the second movable support shaft 48 as a connecting point to the pressing arm 50 of the operating arm 44 are brought into a state of being positioned on a linear line (a toggle mechanism). For this reason, the pressing arm 50 is locked to a state of pressing the pressing rollers 41, 41 against the back surface of the driver supporting base 20, whereby the pressing state of the transmitting portion 20*a* against the drive wheel 15 is firmly maintained.

In this manner, the pressing mechanism 40 has a function to press the pressing rollers 41, 41 against the back surface of the driver supporting base 20, lock this pressing state by the toggle mechanism including the fixed support shaft 47, the first movable support shaft 45, and the second movable support shaft 48, thereby maintaining the pressing state against the drive wheel 15 of the transmitting portion 20*a*. The transmitting portion 20*a* of the driver supporting base 20 is pressed against the outer circumference of the drive wheel 15 with a large force by the pressing mechanism 40, whereby the rotational drive force of the drive wheel 15 is converted into the linear movement in the driving direction of the driver supporting base 20, which is output as a driving force for striking the nail n and driving the same into the driven material W.

In this case, an excessive drive torque in the initial stage of movement of the driver supporting base 20 is absorbed by slipping of the outer wheel 15*b* in the direction of rotation with respect to the inner wheel 15*a* of the drive wheel 15, whereby the slipping of the outer wheel 15*b* (the rubber ring 17) of the drive wheel 15 with respect to the transmitting portion 20*a* of the driver supporting base 20 is restrained, and hence abrasion between the transmitting portion 20*a* and the rubber ring 17 can be avoided.

Further, the outer wheel 15*b* of the drive wheel 15 is supported on the outer peripheral side of the inner wheel 15*a* via the rotational force transmitting member in a state of being capable of relative rotation without play. Therefore, since the outer peripheral surface of the inner wheel 15*a* comes in contact with the inner peripheral surface of the outer wheel 15*b* over the substantially entire surface, the stress at the time of transferring the rotational force is dispersed, whereby the abrasion between the outer peripheral surface of the inner wheel 15*a* and the inner peripheral surface of the outer wheel 15*b* is restrained.

At the rear part (upper side of FIG. 1) of the body housing 7, a returning rubber 60 for upwardly returning the driver supporting base 20 and the driver 21, which have reached a lower limit of movement after having driven the nail n completely, and a winding wheel 61 for winding the same are provided. One end side of the returning rubber 60 is connected to the driver supporting base 20 and the other end side is connected to the winding wheel 61. The winding wheel 61 is rotatably supported by the body housing 7 via a winding shaft 62. The winding wheel 61 is biased in the winding direction by a spiral spring (not shown) housed therein. A stopper 64 for restraining the position of a limit of upward movement (a limit of retracting movement) of the driver supporting base 20 is arranged near the winding wheel 61 at the rear part of the body housing 7. Resilient rubber member is used for the stopper 64, which also has a function to absorb an impact produced when the driver supporting base 20 reaches the position of the limit of the upward movement.

Next, the driver guide 25 is provided with a contact trip 26 for preventing an unintended operation of the drive tool 1. The contact trip 26 is supported so as to be movable in the driving direction with respect to the driver guide 25, and a lower end portion thereof is biased by a spring in the direction protruding from a distal end of the driver guide 25. A trip sensor 35 for sensing the upward movement of the contact trip 26 is arranged in the front part of the body housing 7 as shown in FIG. 2. A well-known limit sensor (a micro switch) is used as the trip sensor 35, and it outputs an on-off signal when a sensing bar 35*a* is tilted.

When the drive tool 1 is pushed toward the driven material W in a state in which the contact trip 26 is brought into contact with the driven material W, the contact trip 26 is moved relatively upward against a spring biasing force. This may serve as the first operation.

When the drive tool 1 is pushed until the distal end of the driver guide 25 comes into contact with the driven material W to move the contact trip 26 relatively upward, the trip sensor 35 is turned on. An on-signal of the trip sensor 35 is output to the control unit C provided in the body housing 7. In addition to the on-off signals of the trip sensor 35, operation of the trigger 4 and operating signals of the electromagnetic actuator 42 etc. are input to and outputted from the control unit C. The drive control of the respective parts by the control unit C will be described later.

The driver guide 25 includes a guide base 25*b* fixed in a state of protruding from the distal end of the body portion 2 and an opening and closing lid 25*c* which is supported to be openable and closable with respect to the guide base 25*b*. The drive hole 25*a* is formed between the guide base 25*b* and the opening and closing lid 25*c*. The opening and closing lid 25*c* can be opened when a locking latch 25*d* is unlocked, whereby removal or the like of the driven members n clogged in the drive hole 25*a* can be achieved.

Next, the pull operation of the trigger 4 is detected by a trigger sensor 8. The pull operation of the trigger 4 may serve as the second operation. When the trigger 4 is pulled, the trigger sensor 8 is turned on and the on-signal is output to the control unit C. A well-known micro switch is used as the trigger sensor 8.

If the trigger sensor 8 is turned on by the pull operation of the trigger 4 and the on-signal is input to the control unit C, and if the contact trip 26 is turned on and t the on-signal of the trip sensor 35 is input to the control device, the power is supplied to the electromagnetic actuator 42 and the driving operation is performed. Thus, the driving operation for the driven member n is performed if both the on operation of the contact trip 26 (the first operation) and the pull operation of the trigger 4 (the second pull operation) are performed, and the driving operation is not performed only with either one of these operations.

Figure 4:
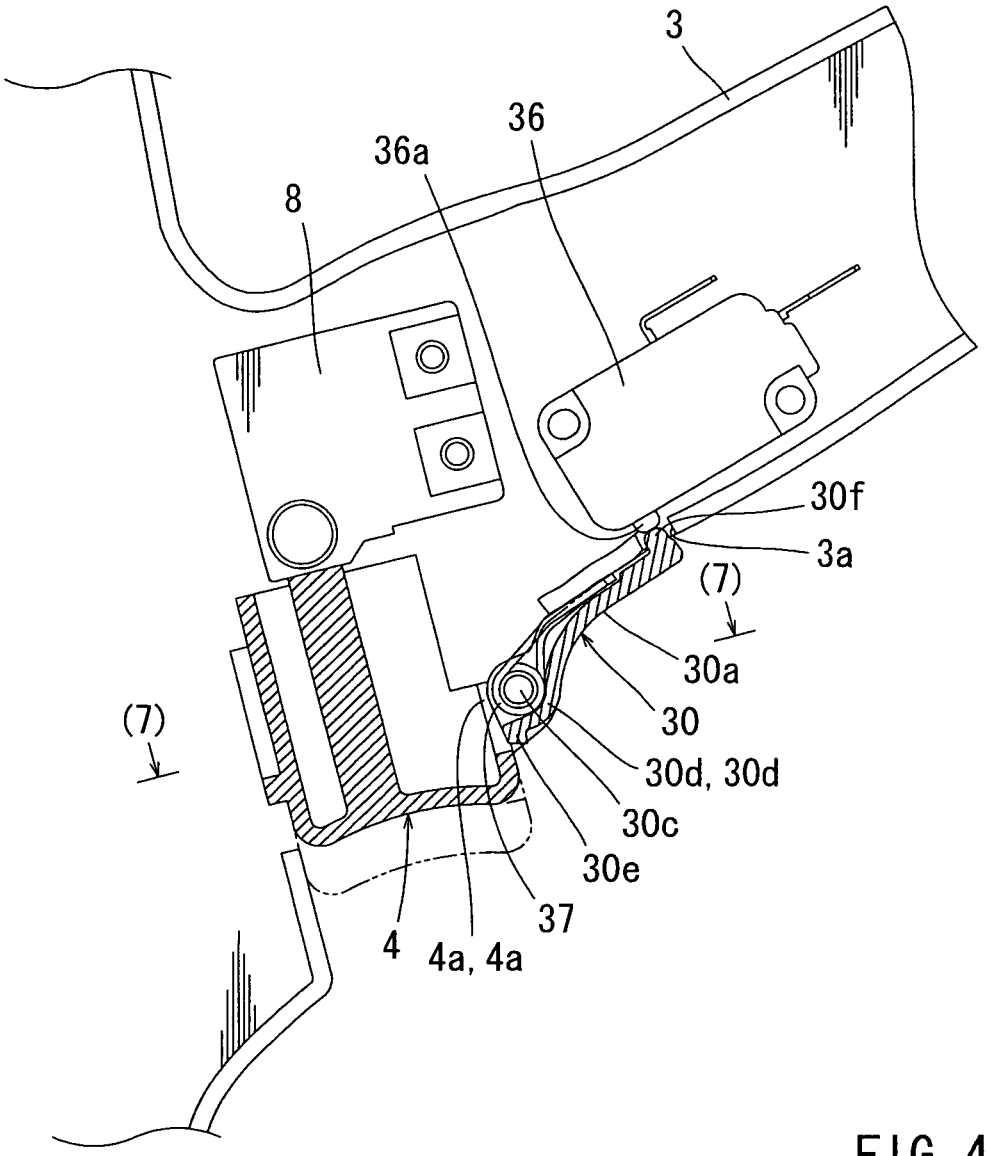
Figure 8:
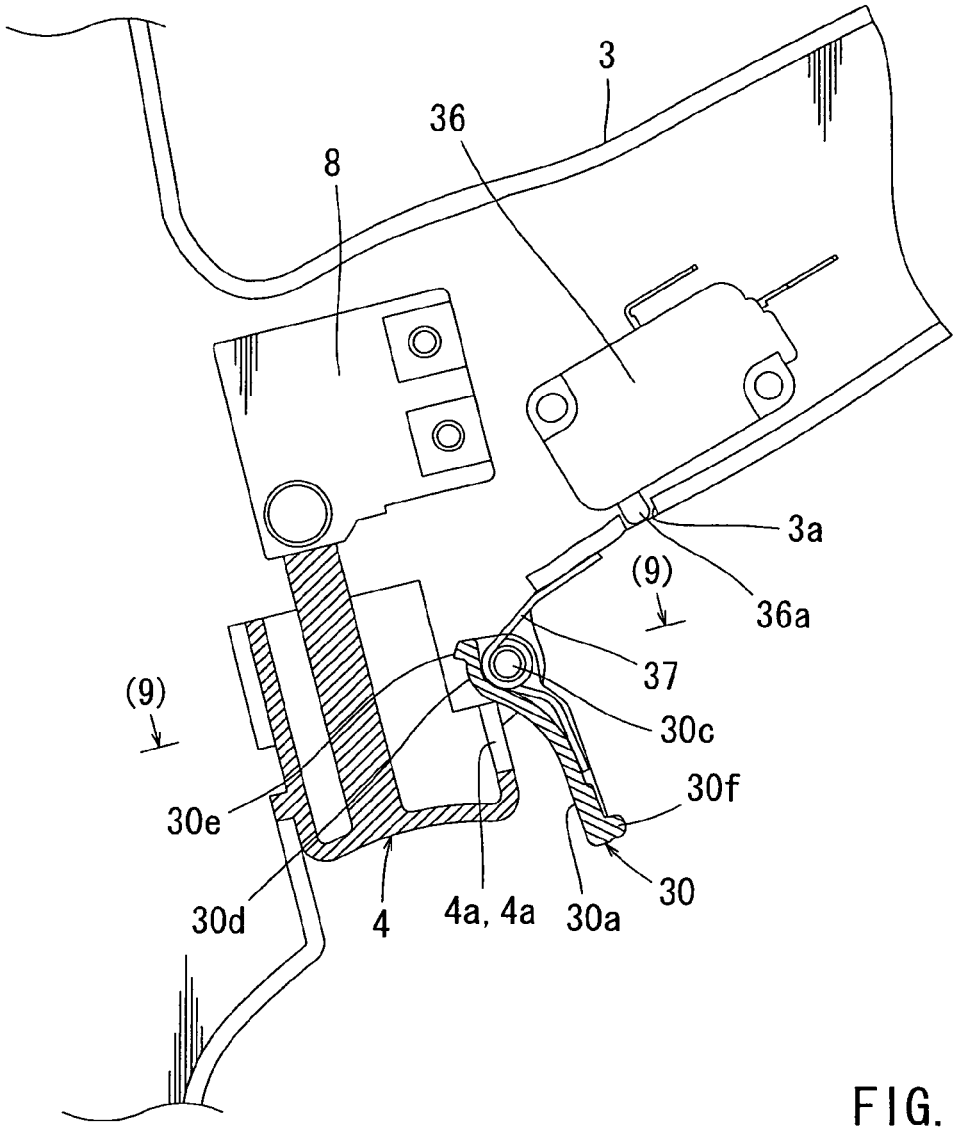
FIG. 8 is a front view of the trigger and the periphery of the lock lever. This figure shows a state in which the lock lever is returned to the locked position and the pull operation of the trigger is restricted.

The pull operation of the trigger 4 is restricted by the lock lever 30. The drive tool 1 according to the embodiment is greatly characterized in that the lock lever 30 is provided. The lock lever 30 and a lock sensor 36 described later may serve as the locking mechanism. FIG. 1 and FIG. 4 show a state in which the lock lever 30 is operated to an unlocked position and the trigger 4 is pulled. In contrast, FIG. 8 shows a state in which the lock lever 30 is returned to the locked position, so that the pull operation of the trigger 4 is prohibited. The unlocking operation of the lock lever 30 may serve as to the third operation.

Figure 5:
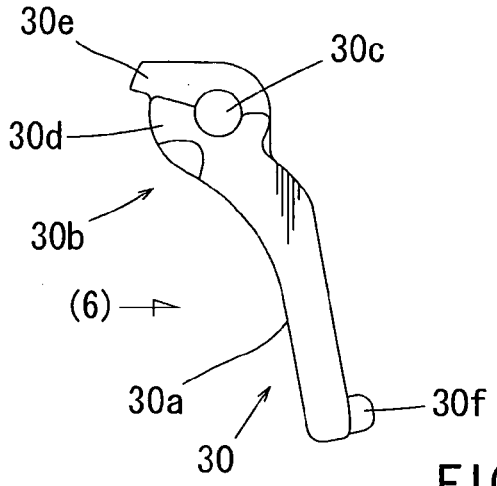
FIG. 5 is a side view of the lock lever.
Figure 6:
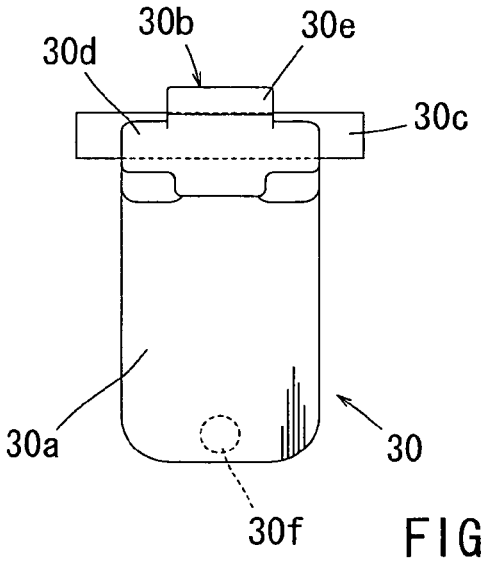
FIG. 6 is a front view of the lock lever.

In FIG. 5 and FIG. 6, the lock lever 30 is shown separately. The lock lever 30 includes a finger-putting part 30*a* and a functional part 30*b*. A supporting shaft 30*c* is attached to the functional part 30*b* in a state of protruding to the both sides in the width direction. The lock lever 30 is rotatably supported on the side of a lower surface of the handle portion 3 and on a lower side of the trigger 4 (right sides in FIGS. 4 and 8) via the supporting shaft 30*c*. The lock lever 30 is biased toward the locking side in FIG. 8 by a torsion spring 37.

As shown in FIG. 5 and FIG. 6, the functional part 30*b* is provided with a wide locking part 30*d* and a narrow unlocking part 30*e* in the width direction (direction of axis of the supporting shaft 30*c*, the lateral direction in FIG. 6). Also, a projection 30*f* is provided at a distal end of the finger-putting part 30*a* on a back side. The projection 30*f* has a cylindrical shape protruding from the back side of the finger-putting part 30*a*, and the distal end portion is formed to be substantially hemispherical.

Figure 7:
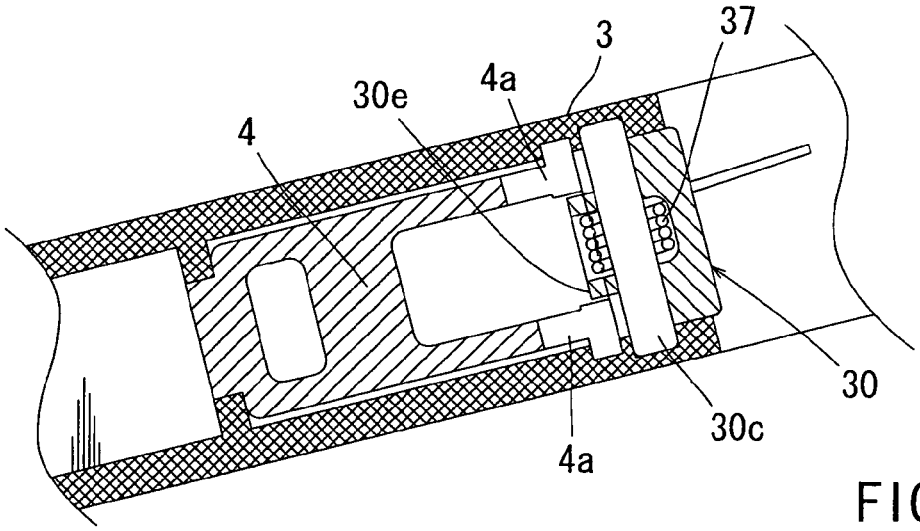
FIG. 7 is a lateral cross-sectional view of the trigger and the periphery of the lock lever taken along the line indicated by arrows (7)-(7) of FIG. 4. This figure shows a state in which the lock lever is unlocked and an unlocking portion thereof is located on the backside of an engaging portion of the trigger.
Figure 9:
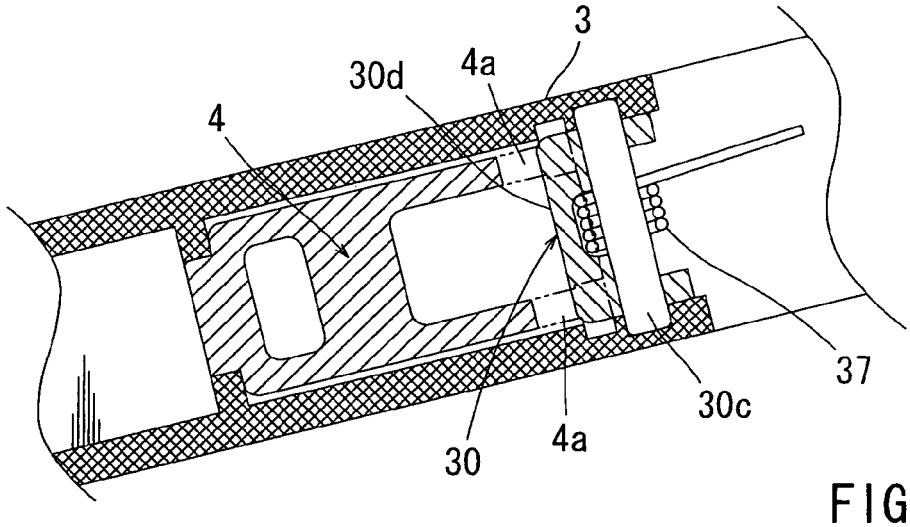
FIG. 9 is a lateral cross-sectional view of the trigger and the periphery of the lock lever taken along the line indicated by arrows (9)-(9) of FIG. 8. This figure shows a state in which the lock lever is returned to the locked position and a locking portion thereof is located on the backside of the engaging portion of the trigger.

On the other hand, as shown in FIG. 7 and FIG. 9, two engaging parts 4*a*, 4*a* at a certain distance from each other are provided on a lower part (right side in FIG. 1) of the trigger 4. The distance between the two engaging parts 4*a*, 4*a* is set to be smaller than the width of the locking part 30*d* of the lock lever 30 and larger than the width of the unlocking part 30*e*. Therefore, the locking part 30*d* cannot enter between the both engaging parts 4*a*, 4*a* as shown in FIG. 7 and, in contrast, the unlocking part 30*e* can enter between the engaging parts 4*a*, 4*a* as shown in FIG. 9.

When the lock lever 30 is rotated to the unlocked position as shown in FIG. 1 and FIG. 4, the narrow unlocking part 30*e* is positioned on the back side of the engaging parts 4*a*, 4*a* of the trigger 4 in terms of the direction of the pull operation as shown in FIG. 7. In this state, the unlocking part 30*e* can enter relatively between the engaging parts 4*a*, 4*a*, and the both engaging parts 4*a*, 4*a* do not interfere with the unlocking part 30*e*, so that the pull operation of the trigger 4*c* can be achieved.

In contrast, in the state in which the lock lever 30 is returned to the locked position shown in FIG. 8, the narrow unlocking part 30*e* is retracted from the back side of both the engaging parts 4*a*, 4*a* of the trigger 4 and the wide locking part 30*d* is positioned as shown in FIG. 9. Since the locking part 30*d* cannot enter between both the engaging parts 4*a*, 4*a*, the pull operation of the trigger 4 is prohibited by the interference of both the engaging parts 4*a*, 4*a* with the locking part 30*d*.

Even when the unlocking operation of the lock lever 30 is released after the pull operation of the trigger 4, the lock lever 30 is maintained at the unlocked position since the locking part 30*d* interferes with both the engaging parts 4*a*, 4*a*. Thereafter, when the pull operation of the trigger 4 is released, the trigger 4 is returned to the off-position by a biasing force of the trigger sensor 8 toward the off-position, whereby the lock lever 30 is returned toward the locked position shown in FIG. 8 by the torsion spring 37.

The locked position and the unlocked position of the lock lever 30 are detected by the lock sensor 36. The lock sensor 36 is also attached in the handle part 3. A well-known micro switch is used as the lock sensor 36. A detecting button 36*a* of the lock sensor 36 can be pressed from the outside via a detecting hole 3*a* provided on the handle part 3. The detecting hole 3*a* is provided corresponding to the projection 30*f* of the lock lever 30, and when the lock lever 30 is rotated to the unlocked position shown in FIG. 4, the projection 30*f* enters the sensing hole 3*a*. Therefore, when the lock lever 30 is rotated to the unlocked position, the projection 30*f* presses the detecting button 36*a* via the detecting hole 3*a*, whereby the lock sensor 36 is turned on. When the lock sensor 36 is turned on, the on-signal is output to the control unit C. On the basis of the on-signal of the lock sensor 36 that is input to the control unit C, the electric motor 11 is started and the drive wheel 15 starts to rotate in a standby state according to the embodiment. When the lock sensor 36 is turned on, a lighting unit 55 is illuminated according to the embodiment.

Figure 10:
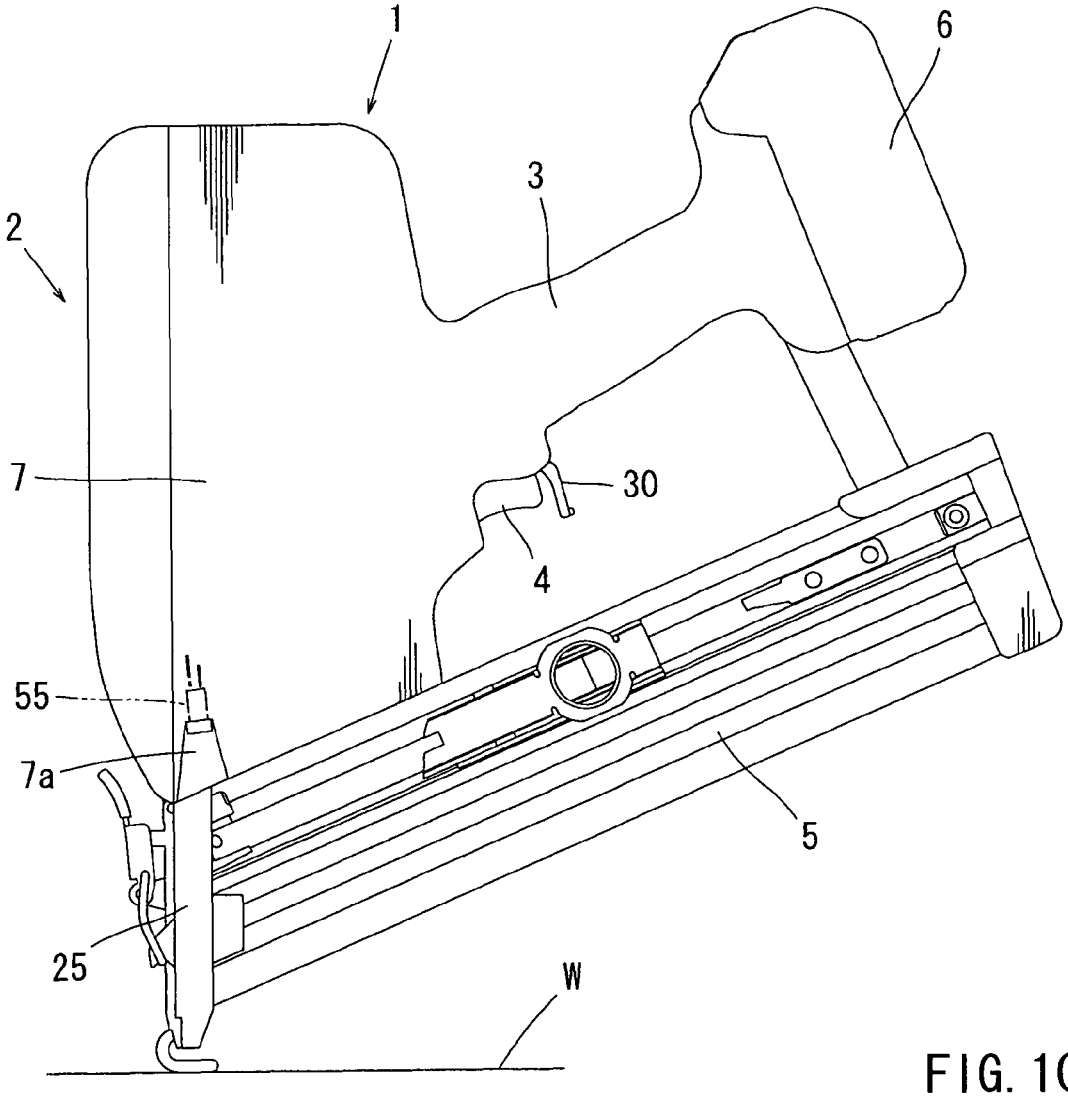
FIG. 10 is a general front view of an electric drive tool according to the embodiment. This figure shows a lighting unit.
Figure 11:
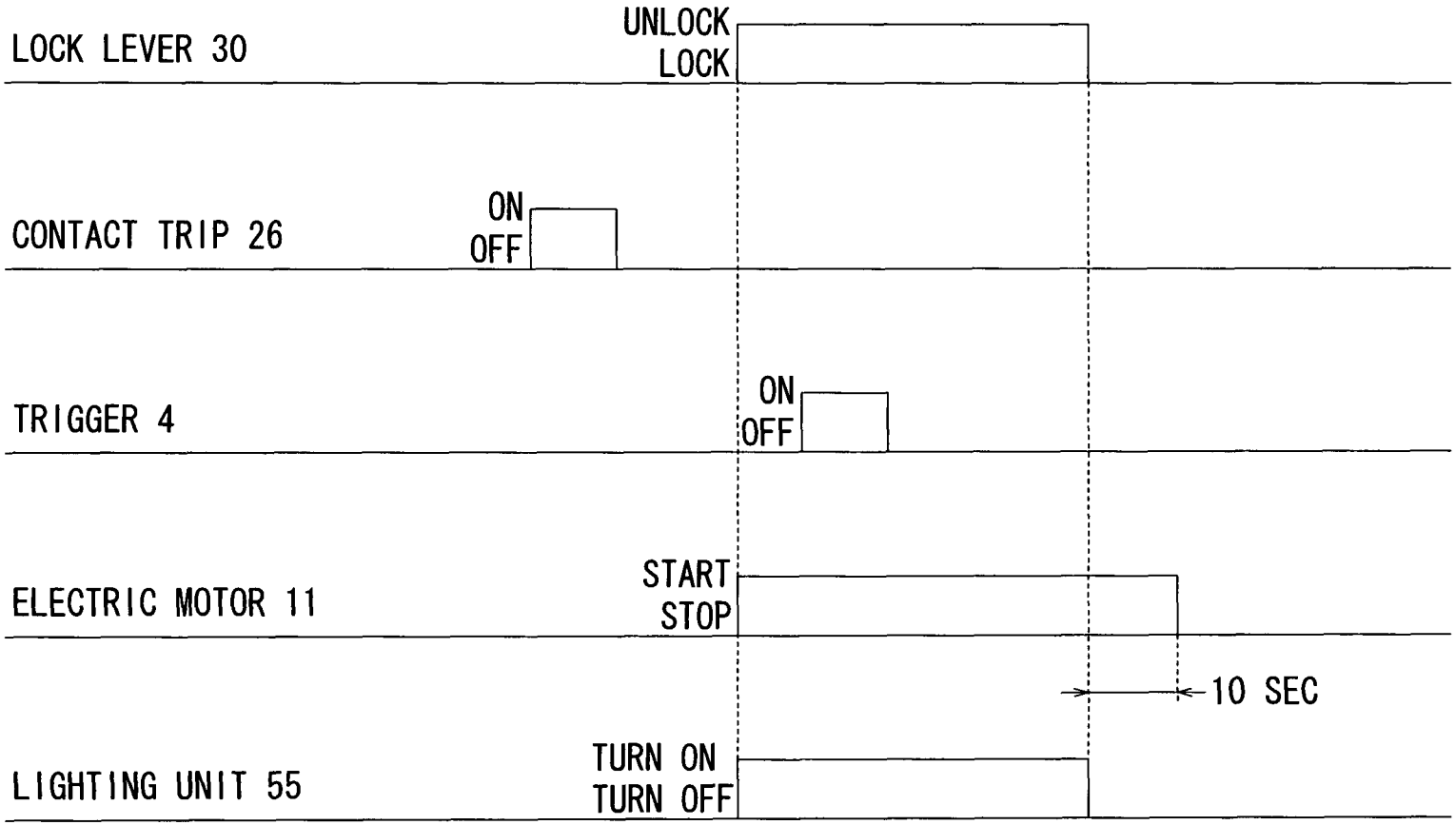
FIG. 11 is a diagram showing operation timings of the respective portions of the electric drive tool according to the embodiment.

The lighting unit 55 is arranged at a distal end of the body portion 2 in the vicinity of the driver guide 25 as shown in FIG. 10. The lighting unit 55 is attached in a state of emitting light from within a recess 7*a* provided on the lateral side of the body housing 7 toward a distal end portion of the driver guide 25 and the periphery thereof. In the present embodiment, one LED (light-emitting diode) is used for the lighting unit 55. Since the driving portion and the periphery thereof are illuminated brightly by the lighting unit 55, the driving operation can be easily made in a dark place, for example, during the night.

In this manner, the lock lever 30 has a function to switch between the state of allowing the pull operation of the trigger 4 and the state of prohibiting the same, a function as a switch for turning on the lighting unit 55, and a function as a switch for starting the electric motor 11. Further, since the lighting unit 55 is illuminated by the rotating operation of the lock lever 30 to the unlocked position, the driving portion can be brightly illuminated for confirmation prior to the driving operation.

When a user stops the rotating operation of the lock lever 30, the lock lever 30 is returned to the locked position shown in FIG. 8 by the biasing force of the torsion spring 37. When the lock lever 30 is returned to the locked position, the push operation to the detecting button 36*a* is released and the lock sensor 36 is turned off. When the lock lever 30 is returned to the locked position, the on-signal from the lock sensor 36 is interrupted and the above-described lighting unit 55 is turned off, and the pull operation of the trigger 4 is brought into a prohibited state as described above.

Next, the operation control of the drive tool 1 on the basis of the on-off signal of the trip sensor 35, the trigger sensor 8 and the lock sensor 36 input into the control unit C, etc. will be described. First of all, in FIG. 11, operating states of the electric motor 11 associated with the operations of the contact trip 26, the trigger 4, and the lock lever 30 are shown.

As shown in FIG. 4, when the unlocking operation is performed by tilting the lock lever 30 downward with the finger tip, the projection 30*f* of the lock lever 30 pushes the detecting button 36*a* of the lock sensor 36, whereby the lock sensor 36 is turned on. This on signal is input into the control unit C and, on the basis of this, the electric motor 11 is started. Also, when the lock lever 30 is unlocked, the lock sensor 36 is turned on and the lighting unit 55 is illuminated. In this manner, the lock lever 30 has both functions as a start switch for the electric motor 11 and as a lighting switch for the lighting unit 55.

On the other hand, as shown in FIG. 8, in a state in which the lock lever 30 is not unlocked (the locked position), even when the body portion 2 is pushed downward to turn the contact trip 26 on (the trip sensor 35 is turned on), the electric motor 11 is not started, and only the lighting unit 55 is lit. When the lock lever 30 is unlocked after the contact trip 26 has been turned on, the electric motor 11 is started.

As described above, when the lock lever 30 is unlocked, the pull operation of the trigger 4 is enabled. Therefore, when the lock lever 30 is unlocked in a state in which the contact trip 26 is turned on, the electric motor 11 is started and the drive wheel 15 starts to rotate in a standby state, and the lighting unit 55 is lit. Thereafter, when the trigger 4 is pulled, the electromagnetic actuator 42 is turned on and the pressing rollers 41, 41 are pressed against the driver supporting base 20, whereby the driver supporting base 20 is moved downward and the driven member n is struck by the driver 21 so as to be driven into the driven material W.

Further, with the drive tool 1 according to the present embodiment, by monitoring and controlling the sequence of the on-operation of the contact trip 26 (turning on the trip sensor 35) and the unlocking operation of the lock lever 30 (turning on the lock sensor 36) by the control unit C, an operating mode of the body portion 2 can be switched to a single shot mode or a continuous shot mode without a troublesome lever operation as in the related art. Also, it is controlled so as not to allow the driving operation in certain sequences of operation.

Figure 16:
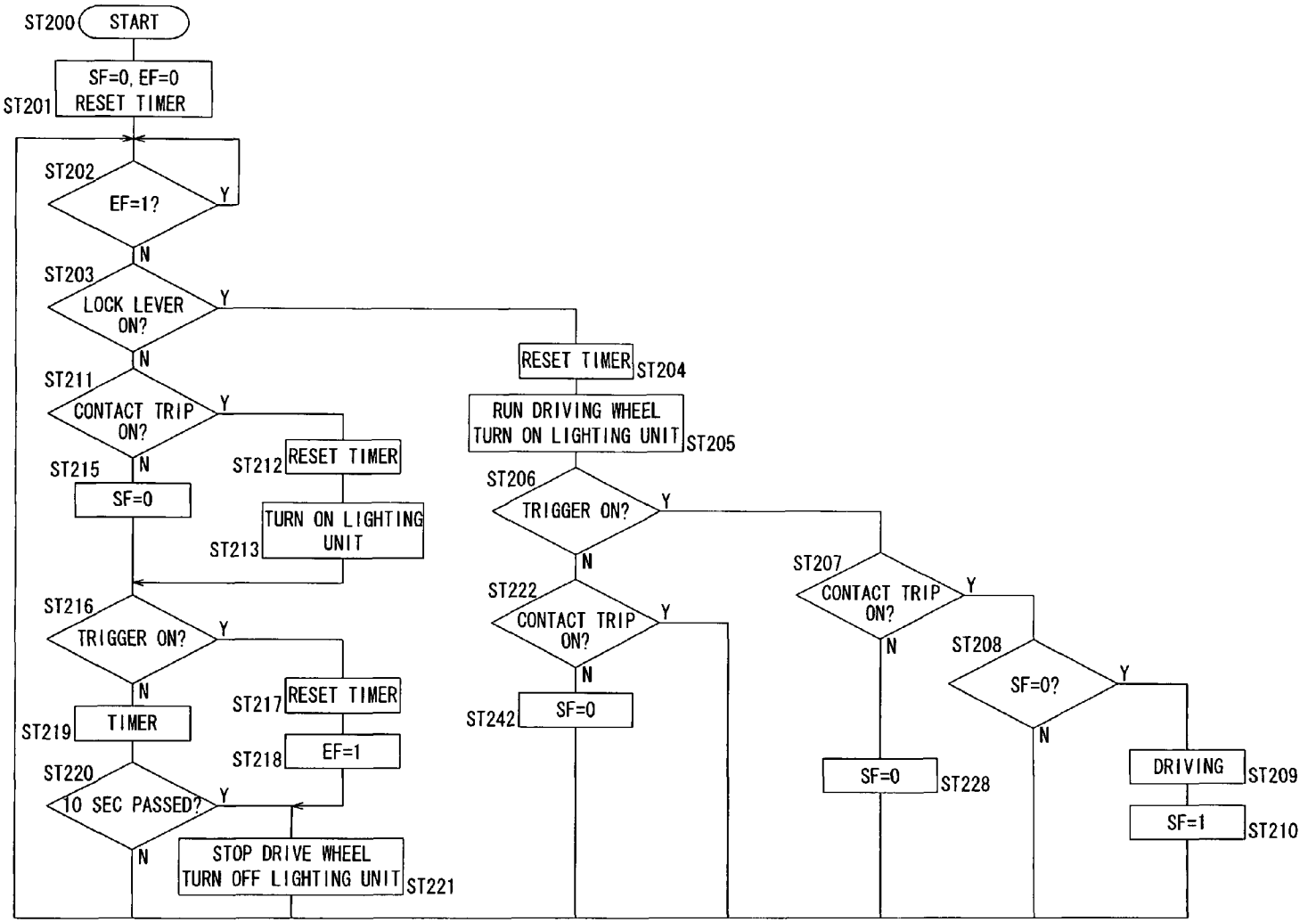
FIG. 16 is a chart showing the control flow of a fourth control mode.
Figure 17:
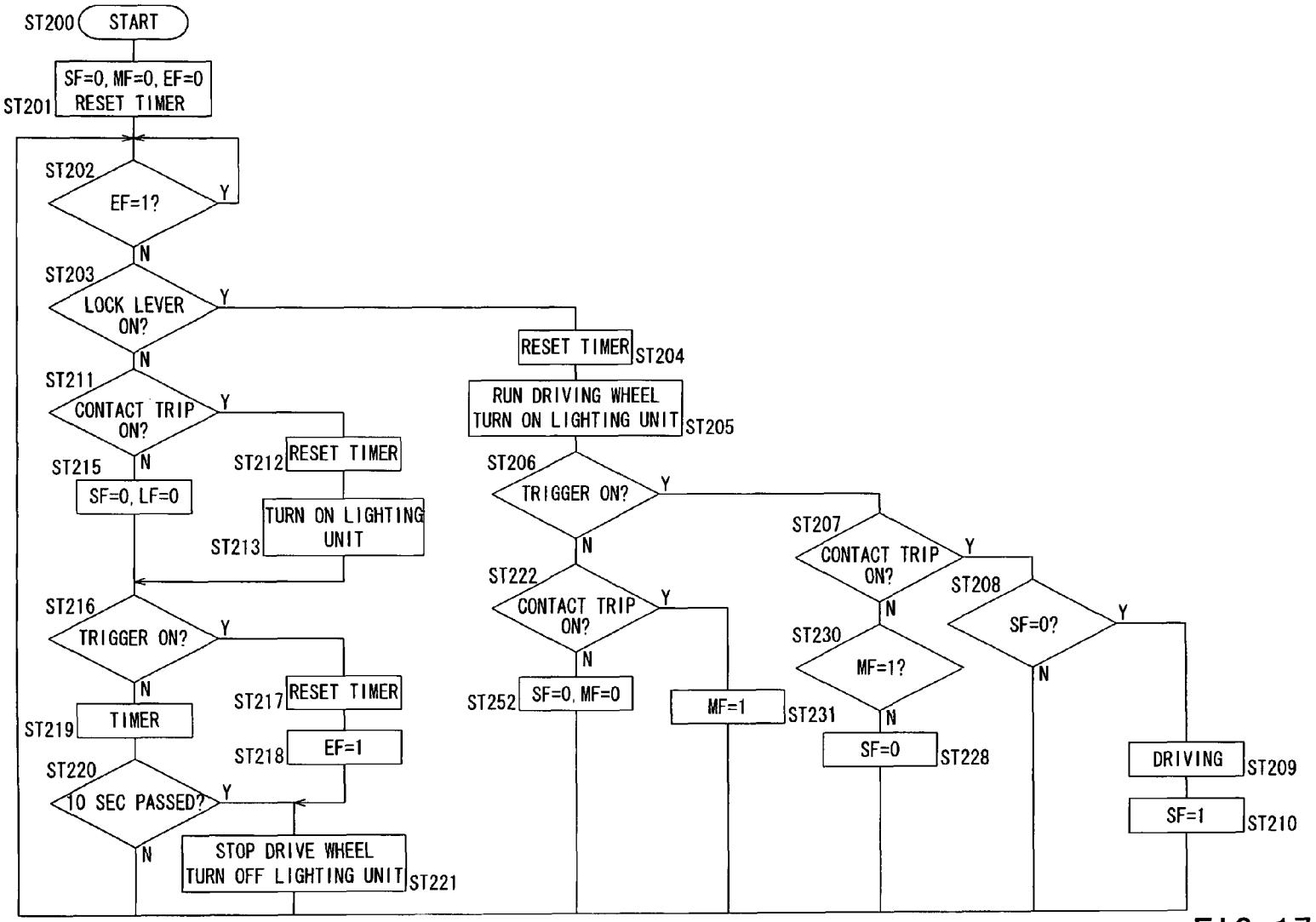
FIG. 17 is a chart showing the control flow of a fifth control mode.

Referring now to FIG. 12 and FIG. 17, various control modes (first to fifth control modes) will be described. FIG. 12 shows a list of operating modes of the body portion 2 for six sequences of operation A to F in the respective control modes. FIG. 13 to FIG. 17 show flowcharts of the first to fifth control modes.

Symbols used in FIG. 12 to FIG. 17 will be defined as follows. The contact trip 26 is abbreviated as "CT", the lock lever 30 is abbreviated as "LL", and the trigger 4 is abbreviated as "T" respectively. Operations that are not the targets of determination by the control unit C are enclosed with parentheses.

Operation sequences D, E, F in FIG. 12 are all erroneous operation sequences, in which the trigger 4 is pulled before the unlocking operation of the lock lever 30, and since these are improper operations which do not lead to normal function of the lock lever 30 of the drive tool 1, no driving operation is performed as a result of "non-operating mode (an error mode)" due to a tool failure (error) in each control mode In addition, in each of flowcharts in FIG. 13 to FIG. 17, an error flag when the tool is defective (for example, as described above, when the trigger 4 is turned on before the unlocking operation of the lock lever 30 is made) is expressed as "EF" and EF=1 means defect, a drive complete flag is expressed as "SF" and SF=1 means that the driving is completed, and a lock lever flag is expressed as "LF" and LF=1 means that CT is turned on before LL. Also, a mode switch flag is expressed as "MF", and the single shot mode is expressed as MF=1.

In the flowcharts shown in FIG. 13 to FIG. 17, a symbol ST is affixed to the respective step numbers.

In the first control mode, mode switching between the continuous shot mode and the single shot mode is performed depending on the sequence of on-operations of the contact trip 26 and the lock lever 30. When the lock lever 30 is turned on and then the contact trip 26 is turned on, the body portion 2 is operated in the continuous shot mode. The driving operation of the body portion 2 is performed by turning the trigger 4 on in addition to the on-operation of the contact trip 26. The sequence of turning ON operation of the trigger 4 is not involved in the switching of the operating mode.

On the contrary, when the contact trip 26 is turned on first and then the lock lever 30 is turned on, the body portion 2 is operated in the single shot mode. In this case as well, the driving operation of the body portion 2 is performed by turning the trigger 4 on in addition to the on-operation of the contact trip 26, and the sequence of on-operation of the trigger 4 is not involved in the switching of the operating mode.

In order to switch the operating mode which is set once as described above, it is necessary to reset the contact trip 26 and the lock lever 30 by turning off both of them.

In the second and fourth control modes, regarding the sequences of operation of on-operation of the contact trip 26 (turning on the trip sensor 35), and the unlocking operation of the lock lever 30 (turning on the lock sensor 36, referred to simply as on-operation, hereinafter), and the pull operation of the trigger 4 (turning on the sensor 8, referred to simply as on-operation, hereinafter), the operating mode of the body portion 2 is determined on the basis of the sequence of operation determined by tracing the sequence of operation back, that is, on the basis of effective three sequences of operation tracing back from the operation immediately before the driving operation of the body portion 2 for the operation which is reset once (off-operation). Therefore, in the second and fourth control modes, the operating mode can be switched by turning off either of the trigger 4 or the contact trip 26.

On the contrary, in the third and fifth control mode, the operating mode is determined under the similar conditions as the second and fourth control modes. However, switching of the operating mode is performed only from the continuous shot mode to the single shot mode, and the reverse switching mode thereof is not performed. In order to switch the mode from the single shot mode to the continuous shot mode, it is necessary to turn off both the trigger 4 and the contact trip 26 once and reset the same. In the second control mode and the third control mode, the body portion 2 is operated in the same operating mode for the respective sequences of operation, and in the fourth control mode and the fifth control mode, the body portion 2 is operated in the same operating mode for the respective sequences of operation.

As shown in FIG. 12, the sequence of operation A in the first control mode is a case in which the lock lever 30 is turned on first, and then the contact trip 26 is turned on (LL→CT), and in this case, the operation of the body portion 2 is controlled in the continuous shot mode. In contrast, the sequence of operation C is a case in which the contact trip 26 is turned on first, and then the lock lever 30 is turned on (CT→LL), and in this case, the operation of the body portion 2 is controlled in the single shot mode.

In the sequence of operation B (LL→T→CT), the driving operation of the body portion 2 is controlled in the continuous shot mode for all control modes.

In the sequence of operation C (CT→LL→T), the driving operation of the body portion 2 is controlled in the single shot mode for all control modes.

In the sequence of operation A in the second control mode, if the sequence of operation is determined to be such that on-operation of the lock lever 30→on-operation of the contact trip 26→on-operation of the trigger 4 (LL→CT→T) for the three operations performed going back in time from the operation performed immediately before a driving operation, the driving operation in the body portion 2 is not performed.

In the sequence of operation B in the second control mode, if the sequence of operation is determined to be such that unlocking operation of the lock lever 30→the pull operation of the trigger 4→on-operation of the contact trip 26 (LL→T→CT) for the same three operations performed going back in time from the operation performed immediately before that, the operating mode of the body portion 2 is switched to a continuous shot mode. In this continuous shot mode, the driving operation can be performed continuously by repeating the on-operation of the contact trip 26.

In the sequence of operation C in the second control mode, if the lock lever 30 is unlocked and then the trigger 4 is turned on after the contact trip 26 is turned on (CT→LL→T) for the same three operations performed going back in time from the operation performed immediately before that, the body portion 2 is switched to a single shot mode.

In the sequence of operation A in the fourth control mode, if the sequence of operation is determined to be such that unlocking operation of the lock lever 30→on-operation of the contact trip 26→on-operation of the trigger 4 (LL→CT→T) for the three operations performed going back in time from the operation performed immediately before that, the operation of the body portion 2 is controlled in a single shot mode. In the sequences of operations B to F, similar controls as in the second control mode are performed, that is, in the sequence of operation B, the operation is controlled in a continuous shot mode, and in the sequence of operation C, the operation is controlled in a single shot mode.

In the sequences of operation A to F in the third control mode, the sequence of operation is determined on the basis of the three sequences of operation performed immediately after the reset, and the same mode switching as in the second control mode is performed.

In the sequences of operation A to F in the fifth control mode, the sequence of operation is determined on the basis of the three sequences of operation performed immediately after the reset, and the same mode switching as in the fourth control mode is performed.

The respective control modes will be described below according to control flows.

Figure 13:
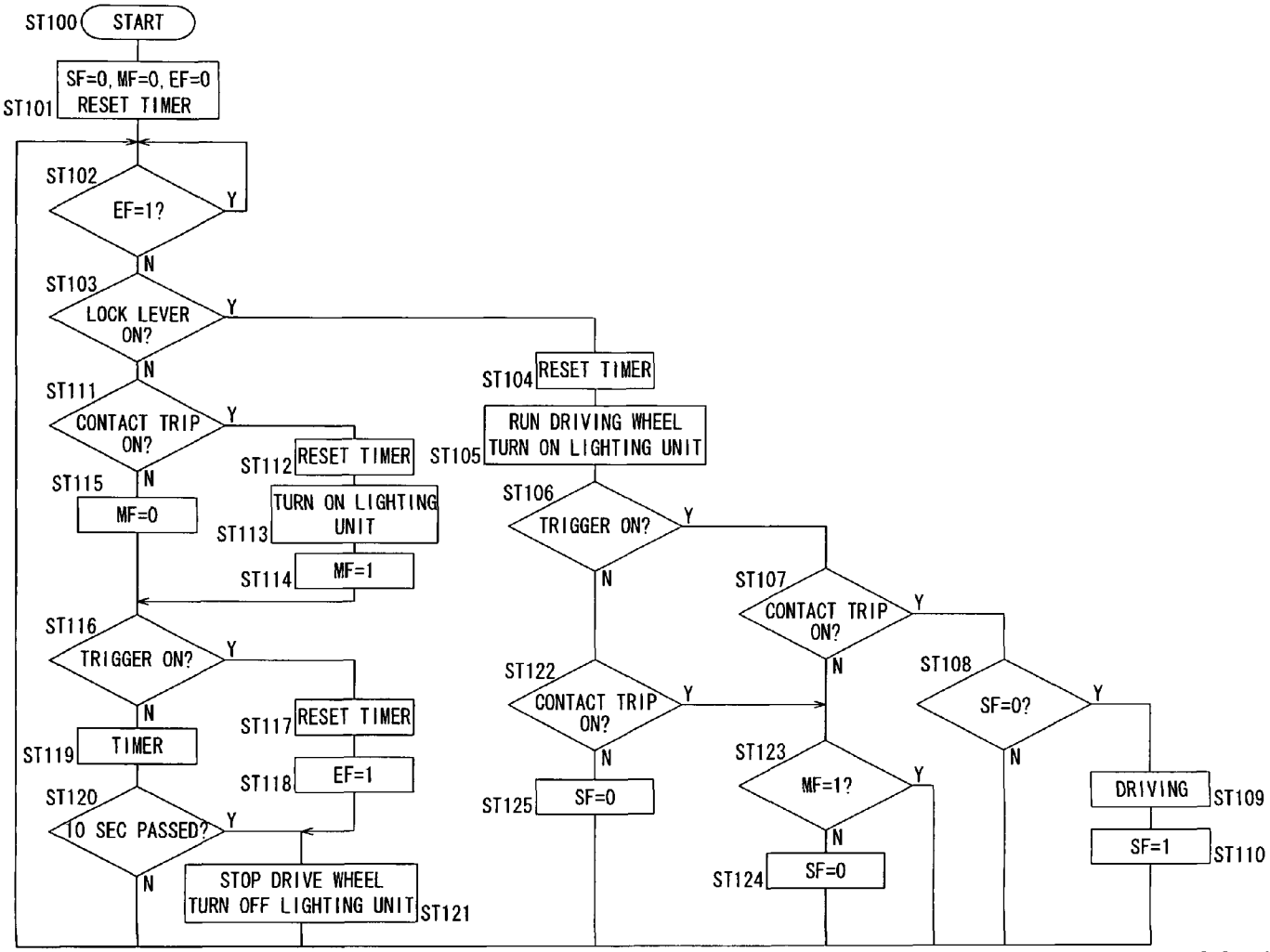
FIG. 13 is a chart showing the control flow of a first control mode.

FIG. 13 shows the control flow of the first control mode. In the first control mode, the operating mode of the body portion 2 is controlled on the basis of the sequences of operation of the two members; the contact trip 26 and the lock lever 30. The sequence of operation of on-operation of the trigger 4 is not involved in the mode switching.

Further, in the first control mode, controlled objects are an error flag EF, a drive complete flag SF, and a mode switch flag MF.

The sequence will be described below from Step 100 which shows an initial state (non-operation state).

The control flow starts from Step 100 (hereinafter, simply referred to as ST100). In ST101, the respective flags are reset and the timer counter is reset. In a state in which none of the lock lever 30, the contact trip 26, and the trigger 4 is operated, EF=0 is confirmed (diagnose a failure) in ST102, and then, MF is reset to MF=0 in ST 103→ST111→ST115, and the timer counter starts in ST116→ST119. Until the timer counter counts 10 seconds in ST120, a control flow of ST102→ST103→ST111→ST115→ST116→ST119→ST120→ST102 is repeated. When the elapse of 10 seconds is confirmed in ST120 after the timer has started, the electric motor 11 stops, the drive wheel 15 stops, and the lighting unit 55 is turned off, or the stopping and off state of these members are confirmed in ST121.

In the control flow of the non-operating state, the sequence of operation A (LL→CT→T) and the sequence of operation B (LL→T→CT) will be described first. In either sequence of operation A or B, the operating mode of the body portion 2 is controlled in the continuous shot mode.

In a state in which on-operation of the lock lever 30 is only performed, when EF=0 (non erroneous operation state) is confirmed in ST102 and the unlocking operation of the lock lever 30 is confirmed in ST103, the timer counter is reset once in ST104, and then, the electric motor 11 is started, the drive wheel 15 starts to rotate in a standby state, and the lighting unit 55 is turned on in ST105. The standby state as described above is controlled in a circulation flow of ST102→ST103→ST104→ST105→ST106→ST122→ST125→ST102.

When the contact trip 26 is turned ON in this standby state, this is confirmed in ST122, and then, MF=0 is confirmed in ST123 and SF=0 is reset in ST124. Therefore, when the trigger 4 is turned on thereafter, this is confirmed in ST106, and then the fact that SF=0 is confirmed in ST107→ST108, and the driving operation is performed in ST109. After the driving operation, SF is switched to SF=1 in ST110. However, since the procedure does not go to ST111 as long as the lock lever 30 is turned on, MF is maintained at MF=0 and hence the MF=1 is not confirmed in ST123. Therefore, by turning the trigger 4 off once, the drive complete flag SF is reset in ST124 and SF is returned to SF=0. Thus, every time the trigger 4 is turned on again thereafter, the driving operation can be performed continuously in ST107→ST108→ST109.

Further, as long as the state in which the lock lever 30 is turned on is maintained, even though the state in which the trigger 4 is pulled is continued, when on-operation of the contact trip 26 is released once, SF is reset to SF=0 in ST106→ST107→ST123→ST124, so that the driving operation can be performed continuously in ST107→ST108→ST109 every time the contact trip 26 is turned on again.

In this manner, the drive complete flag which has become SF=1 in ST110 is reset to SF=0 in ST124 by turning on the trigger 4 or the contact trip 26 once, as long as the lock lever 30 is kept ON and the MF=0 is maintained. The operation control of the continuous shot mode according to the sequence of operation A or the sequence of operation B in the first control mode has been described above.

Next, the sequence of operation C for turning on the contact trip 26 first and then turning on the lock lever 30 in the control flow in the non-operating state (ST102→ST103→ST111→ST115→ST119→ST120) will be described. In the sequence of operation C, the operation of the body portion 2 of the tool is controlled in the single shot mode.

In this case, after having reset the time counting by the timer counter in ST111→ST112, the lighting unit 55 is turned on in ST113, and the mode switch flag MF is switched to MF=1. Thereafter, when the lock lever 30 is turned on, the control is made according to the circulation flow of ST103→ST104→ST105→ST106→ST122→ST123→ST102. When the trigger 4 is pulled in the state of this standby operation, the driving operation is performed in ST106→ST107→ST108→ST109. After having completed the driving operation, the drive complete flag SF is switched to SF=1 in ST110.

Thereafter, when the pull operation of the trigger 4 is once released while maintaining the state of the on-operation of the contact trip 26, MF=1 is confirmed in ST103→ST104→ST105→ST106→ST122→ST123, and hence the flow is returned to ST102. The mode switch flag MF is maintained at MF=1 and the drive complete flag SF is not reset in ST125 or ST124, so that the SF=1 is maintained in the control flow. Therefore, since SF=0 is not confirmed in ST106→ST107→ST108 even though the trigger 4 is pulled again, the control flow is returned to ST102, and hence the driving operation is not performed.

In this single shot mode, the drive complete flag SF is needed to be reset to SF=0 in order to perform the driving again and, in order to do so, the on-operation of the trigger 4 and the contact trip 26 are all needed to be released once. When the on-operation of these members are all released, the drive complete flag SF is reset to SF=0 in ST103→ST104→ST105→ST106→ST122→ST125. Thereafter, when the on-operations of the contact trip 26 and the trigger 4 are performed in this order, the driving is performed again in ST106→ST107→ST108→ST109. Since SF is switched to SF=1 after the driving, the SF is needed to be reset to SF=0 by releasing the on-operation of the trigger 4 and the contact trip 26 in order to perform the driving again. In the meantime, the lock lever 30 is maintained in the on-operation state.

When all of the trigger 4, the contact trip 26, the lock lever 30 are released, the control flow of ST102→ST103→ST111→ST115→ST116→ST119→ST120→ST102 is maintained for 10 seconds, and then the electric motor 11 stops, the lighting unit 55 is turned off, and the drive tool 1 is returned to the initial state (stopping state) via ST121. The operation control of the single shot mode according to the sequence of operation C in the first control mode has been described above.

In this manner, according to the first control mode, the driving operating mode of the body portion 2 can be switched to the continuous shot mode or the single shot mode by controlling the sequence of the on-operation of the contact trip 26 and the lock lever 30. The trigger 4 can be turned on only in a state where the lock lever 30 is turned on. The operation of the trigger 4 must be performed only after the operation of the lock lever 30 is made, and does not involved in the switching of the operating mode. In the first control mode, the operating mode is determined by the sequence of operation of the contact trip 26 and the lock lever 30.

Figure 14:
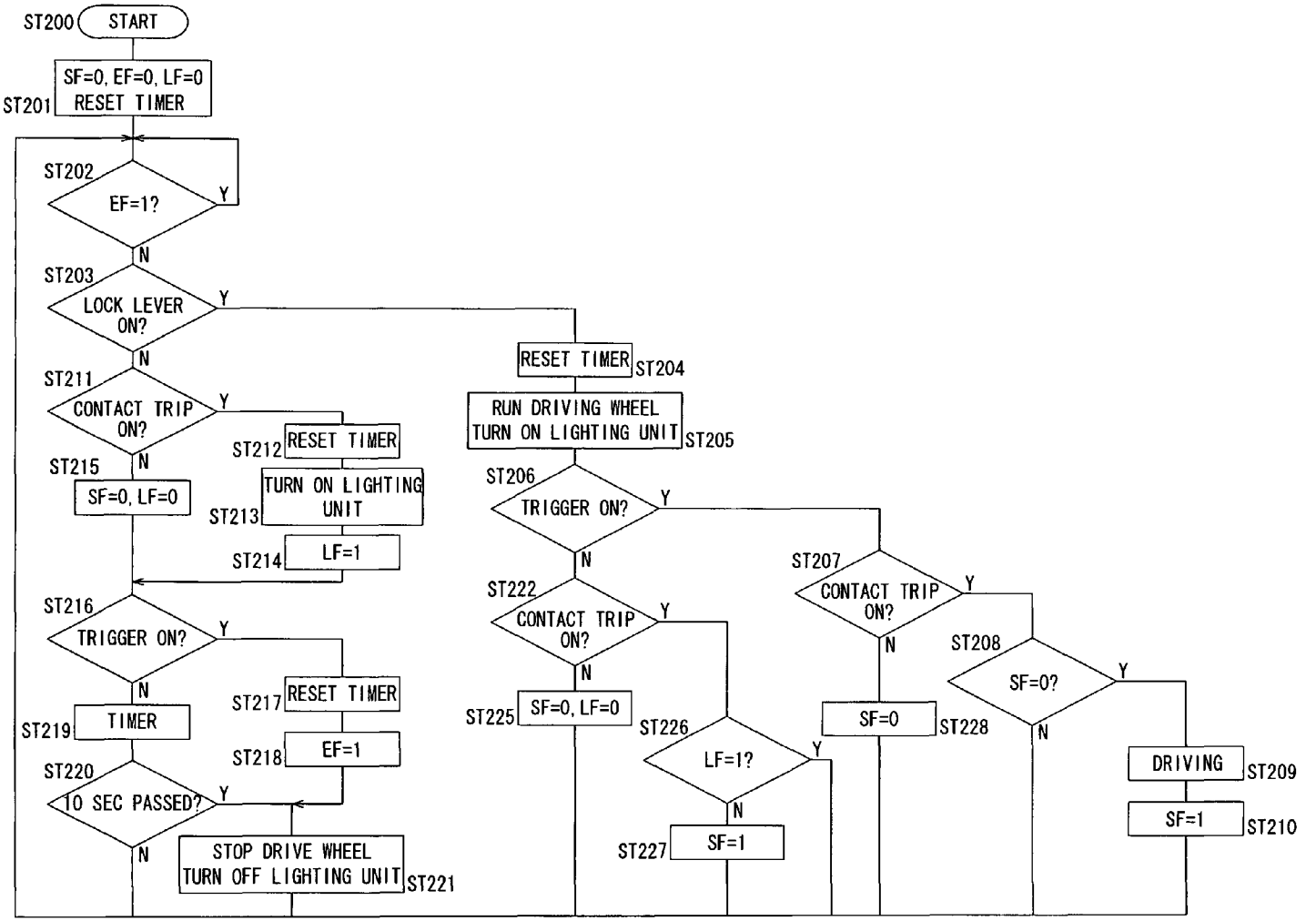
FIG. 14 is a chart showing the control flow of a second control mode.

Next, the control flow in the second control mode is shown in FIG. 14. In the second to fifth control modes, the operating mode is switched on the basis of the sequence of operation of the three members; the contact trip 26, the lock lever 30, and the trigger 4. In this regard, these control modes differ from the first control mode described above.

In the second control mode, the targets of control are the error flag EF, the drive complete flag SF, and the lock lever flag LF.

As shown in FIG. 14, when the control flow starts (Step 200, hereinafter, simply referred to as ST200), the drive complete flag SF, the tool failure flag EF, and the lock lever flag LF are reset to zero respectively (ST201). Thereafter, the tool failure flag EF is confirmed first (ST202) and, if the unlocking operation of the lock lever 30 (turning on the lock sensor 36) is performed when EF is not EF=1 (ST203), the timer counter is reset in ST204, and then the electric motor 11 is started and hence the drive wheel 15 starts to rotates in a standby state and the lighting unit 55 is turned on in ST205. Thereafter, in the state in which the trigger 4 and the contact trip 26 are not turned on, the control flow is returned back to ST202 via ST206→ST222→ST225.

In the sequence of operation A, when the contact trip 26 is turned on in the above-described circulation flow, the drive complete flag SF is switched to SF=1 in the ST222→ST226→ST227, and then the control flow is returned back to ST202. Therefore, even if the trigger 4 is pulled thereafter, the control flow is returned to ST202 while maintaining the state of SF=1 via ST206→ST207→ST208 and the driving operation is not performed.

In the sequence of operation B, when the contact trip 26 is turned on (ST207) after having turned the trigger 4 on in the state in which the lock lever 30 is turned on (ST206), SF=0 is confirmed in ST208, and hence the electromagnetic actuator 42 is turned on in the body portion 2, and the driving operation is performed (ST209). After having completed the driving, the drive complete flag SF is switched to SF=1, and the flow returns to ST202. Therefore, by turning off the contact trip 26 and the trigger 4 while maintaining the on-operation of the lock lever 30 thereafter, the drive complete flag SF is returned to SF=0 in ST225, and the state in which the driving is enabled is achieved again. Further, after having completed the driving, when the on-operation of the contact trip 26 is released while maintaining the on-state of the lock lever 30 and the trigger 4, the drive complete flag SF is reset to SF=0 in ST207→ST228, and by turning on the contact trip 26 again, the continuous driving can be achieved (continuous shot mode). In this manner, when the trigger 4 is turned on before turning on the contact trip 26 according to the sequence of operation B in the second control mode, the operation of the body portion 2 is controlled in the continuous shot mode.

When the trigger 4 is turned off first in this continuous shot mode, since the drive complete flag SF is switched to SF=1 via ST206→ST222→ST226→ST227, the driving operation is not performed after that in the same manner as the sequence of operation A.

In the sequence of operation B, when on-operation of the lock lever 30, the contact trip 26, and the trigger 4 are all released, the control flow returns to ST202 via ST203→ST211→ST215→ST216→ST219→ST220 and this flow continues for 10 seconds, and then the electric motor 11 stops, the drive wheel 15 stops, and the lighting unit 55 is turned off in ST221, and the drive tool 1 returns to the initial state (non-operating state).

In the sequence of operation C in the second control mode (CT→LL→T), firstly by turning on the contact trip 26, the lock lever flag LF is switched to LF=1 by ST211→ST212→ST213→ST214 and, when the lock lever 30 is turned on in this state, the control flow is transferred to ST203→ST204→ST205→ST206→ST222→ST226→ST202 and, when the trigger 4 is turned on in this state, the driving operation is performed in ST206→ST207→ST208→ST209. After having completed the driving operation, the drive complete flag SF is switched to SF=1 in ST210 and the control flow returns to ST202.

Thereafter, when the on-operation of both the trigger 4 and the contact trip 26 is released, the drive complete flag SF is reset to SF=0 in ST206→ST222→ST225 and the lock lever flag LF is reset to LF=0. Therefore, when the contact trip 26 is turned on again and then the trigger 4 is turned on, the driving operation is performed in ST203→ST204→ST205→ST206→ST207→ST208→ST209.

On the contrary, after having completed the driving operation, even if the trigger 4 is turned off once after the drive complete flag SF is switched to SF=1 in ST210 and is turned on again, the drive complete flag SF is not reset to SF=0 by ST206→ST222→ST226→ST227, so that the driving operation cannot be performed again unless the contact trip 26 is turned off once (single shot mode).

Figure 15:
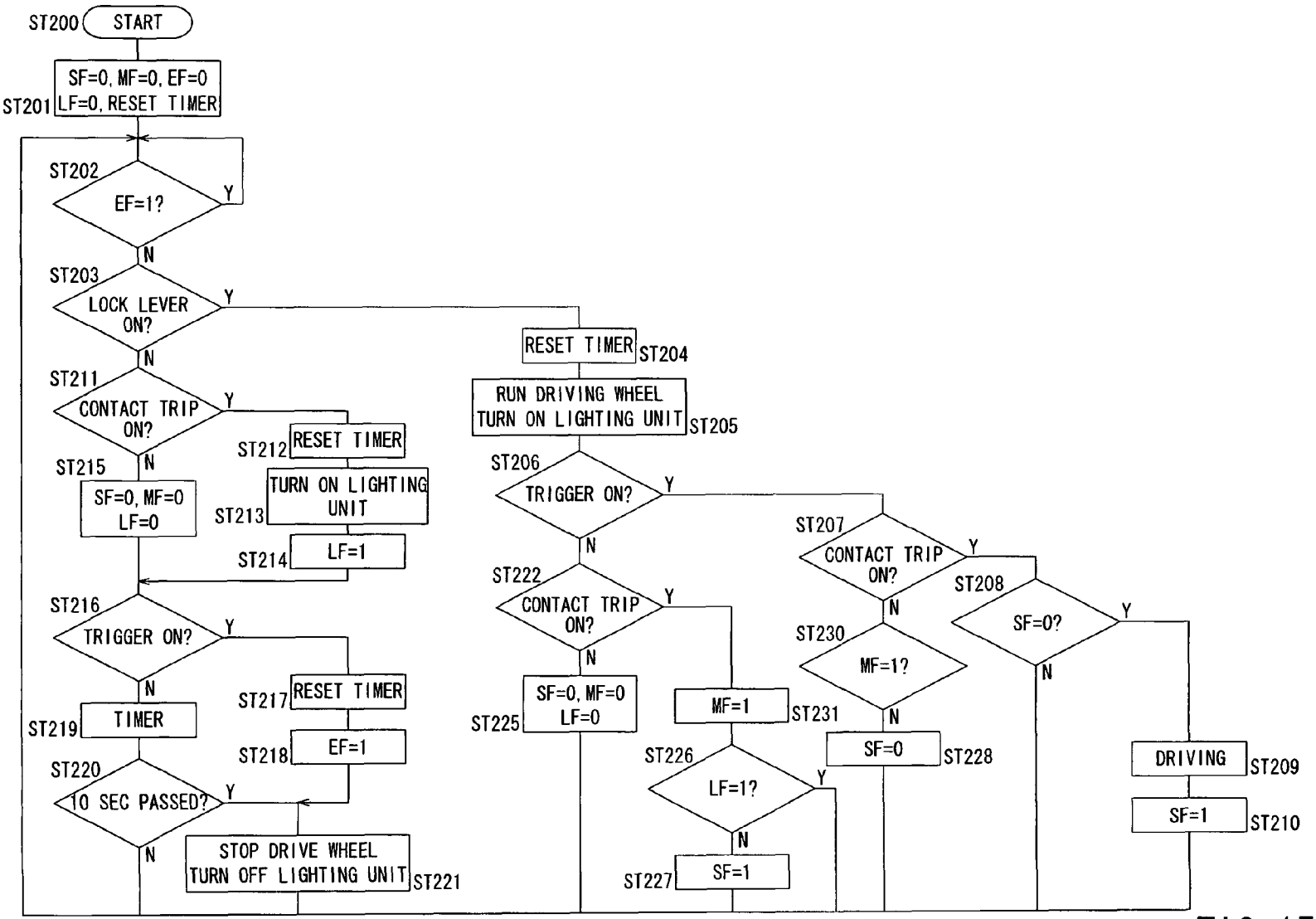
FIG. 15 is a chart showing the control flow of a third control mode.

Next, FIG. 15 shows the control flow according to the third control mode. As described above, in the second control mode and the third control mode, the same operating mode is output for the respective sequences of operation.

In the same manner as in the second control mode, the body portion 2 is not operated in the sequence of operation A (LL→CT→T), and the body portion 2 is operated in the continuous shot mode in the sequence of operation B (LL→T→CT), and the body portion 2 is operated in the single shot mode in the sequence of operation C (CT→LL→T).

The third control mode differs from the second control mode in that a mode switch flag MF is added to a controlled object. Also, as is clear when comparing FIG. 14 with FIG. 15, the second control mode differs from the third control mode in that the mode switch flag MF is added in ST201, ST215, and ST225, and determination is made in ST230 between ST207 and ST228, and MF is switched to MF=1 in ST 231 between ST222 and ST226. Other steps which are the same as in the second control mode are designated by the same step number instead of describing again.

In the case of the third control mode, when the operation of the sequence of operation A (LL→CT→T) is performed, since SF is switched to SF=1 via ST203→ST204→ST205→ST206→ST222→ST231→ST226→ST227 by turning on the lock lever 30 and the contact trip 26 in this sequence, the control flow is returned back in ST206→ST207→ST208→ST202 even when the trigger 4 is pulled thereafter, the driving operation is not performed. In this respect, the third control mode is the same as the second control mode.

When the operation of the sequence of operation B (LL→T→CT) is preformed, the driving operation is performed by ST203→ST204→ST205→ST206→ST207→ST208→ST209. SF is switched to SF=1 in ST210 after the driving operation for the first time, and when the contact trip 26 is turned off thereafter once, SF is reset to SF=0 in ST228, so that the continuous driving operation is enabled by turning on the contact trip 26 again (continuous shot mode).

When the operation of the sequence of operation C (CT→LL→T) is performed, LF is switched to LF=1, and then the driving operation for the first time is performed by ST203→ST204→ST205→ST206→ST207→ST208→ST209, and SF is switched to SF=1. When the pull operation of the trigger 4 is turned off once after the driving operation for the first time, MF is switched to MF=1 in ST231, and the control flow returns to ST203 in the state of SF=1. Therefore, even if the trigger 4 is pulled again, the driving operation is not performed since the control flow returns to ST203 via ST208 (single shot mode). Further, even when the contact trip 26 is turned off once after the driving is made for the first time, MF is MF=1 is confirmed via ST207→ST230, and hence the control flow returns to ST203 and the driving is not performed (single shot mode).

On the contrary, when both the trigger 4 and the contact trip 26 are turned off after the driving operation is made for the first time, the respective flags are all reset via ST206→ST222→ST225. Therefore, when both the trigger 4 and the contact trip 26 are turned off once while maintaining the lock lever 30 to be in a on-state, and then the trigger 4 (the sequence of operation B) or the contact trip 26 (the sequence of operation A) is turned on again, the sequence of control is switched to the sequence of control B in the former case and to the sequence of control A in the latter case, and hence the operating mode is switched to the continuous shot mode in the former case and to the non-operating mode in the latter case. Further, when the trigger 4, the contact trip 26, and the lock lever 30 are all turned off after the driving operation is made for the first time, the elapse of 10 seconds after the trigger is turned off is confirmed in ST216→ST219→ST220 and, consequently, the standby rotation of the drive wheel 15 stops in ST211 and the lighting unit 55 is turned off, so that the drive tool 1 returns to the initial state.

Next, FIG. 16 shows the control flow according to the fourth control mode, and FIG. 17 shows the control flow according to the fifth control mode. The fourth and fifth control modes differs from the first to third control modes in that the single shot mode is also output in the sequence of operation A. In the case of the sequence of operation B, the continuous shot mode is output in the same manner as the second and third control modes, and in the case of the sequence of operation C, the single shot mode is output in the same manner as the first to third control modes. In the sequences of operation D, E, and F, the error mode is output, and the body portion 2 is not operated.

In the case of the fourth and fifth modes, the lock lever flag LF is excluded from a controlled object. In the fourth control mode, the body portion 2 is controlled on the basis of the two flags; the error flag EF and the drive complete flag SF. The fifth control mode differs from the fourth control mode in that the mode switch flag MF is added to a controlled object. Therefore, the control flow in the fourth control mode shown in FIG. 16 differs from the control flow in the second control mode shown in FIG. 14 in that ST201, ST215, ST225 are different (ST240, ST241, ST242) and ST214, ST226, and ST227 are omitted. Further, the control flow in the fifth control mode shown in FIG. 17 differs from the control flow in the third control mode shown in FIG. 15 in that ST201, ST215, ST225 are different and ST214, ST226, and ST227 are omitted. The steps which are not needed to be changed are designated by the same step numbers instead of describing again.

In the case of the fourth and fifth control modes, when the operation of the sequence of operation A (LL→CT→T) is performed, the control flow returns to ST202 via ST203→ST204→ST205→ST206→ST222 by the operation of LL→CT first, and then when the trigger 4 is turned on, the driving operation for the first time is performed in ST206→ST207→ST208→ST209. When the driving operation is completed, SF is switched to SF=1.

Even when the on-operation of the trigger 4 is released once thereafter, since the control flow returns to ST202 while maintaining SF=1, the control flow is returned in ST208→ST202 and the driving operation is not performed (single shot mode) even when the trigger 4 is turned on again thereafter. In this respect, the fourth control mode is the same as the fifth control mode.

In the case of the fourth control mode, when the on-operation of the contact trip 26 is released once after the driving operation is made for the first time, the sequence of operation is switched to sequence of operation B because SF is reset to SF=0 by ST207→ST228, so that when the contact trip 26 is turned on again, the driving operation is performed in the continuous shot mode.

On the contrary, in the case of the fifth control mode, since the MF is switched to MF=1 in ST231 and this state is maintained, even when on-operation of the contact trip 26 is released once after the driving operation is made for the first time, the control flow is returned in ST230→ST202 and SF is not switched to SF=0, so that the driving operation is not performed and hence the single shot mode is maintained. In the case of the fifth control mode, SF and MF are switched to SF=0 and MF=0 via ST206→ST222→ST252 by releasing the on-operation of both the trigger 4 and the contact trip 26, so that the driving operation after that is enabled.

In the fourth and fifth control modes, the operations when the sequence of operation B (LL→T→CT) and the sequence of operation C (CT→LL→T) are performed are basically the same as those in the second and third control modes, and hence the description is omitted.

According to the electric drive tool 1 in the embodiment as described thus far, in order to turn on the trigger 4, the lock lever 30 attached therewith is needed to be unlocked (on-operation), so that an unintended pull operation of the trigger 4 is prevented and thus an erroneous operation of the electric drive tool 1 is prevented.

Further, according to the first control mode of the electric drive tool as exemplified, switching between a continuous shot mode and a single shot mode can be made by changing an operational sequence of the first operation and the third operation. Conventionally, a specially provided mode switching lever is needed to be operated, and it was troublesome for operation, but according to the first control mode as exemplified, the operating mode can be switched based on the operational sequence between the on-operation of the contact trip 26 and the on-operation of the lock lever 30, which restricts the on-operation of the trigger 4, not based on the on-operation of the trigger 4. In this respect, the switching operation of the operating mode can be rapidly and easily performed than previously made.

In the second to fifth control modes, switching between the continuous shot mode and the single shot mode can be made by changing the operational sequence of the three operations including the on-operation of the contact trip 26 (first operation), the pull operation of the trigger 4 (second operation) and the unlock operation of the lock lever 30 (third operation), and therefore, the function of the locking mechanism can be increased and further diversification of the switching mechanism for the operating mode can be achieved.

Further, in the second control mode or the fourth control mode, the operating mode can be switched based on the operational sequence just before the performance of the driving operation. Therefore, the operating mode can be switched without resetting all of the on-operation of the contact trip 26, the on-operation of the trigger 4, and the on-operation of the lock lever 30 by maintaining either one of them in the on-state and changing the operational sequence of the other two operations.

On the other hand, in the third control mode or the fifth control mode, unintended switching to the continuous shot mode is not made because the operating mode can be switched preferentially to the single shot mode. In this respect, the third or fifth control mode is meaningful.

Further, the pull operation of the trigger 4 is restricted by the lock lever 30 of the locking mechanism. That is, the pull operation of the trigger 4 cannot be performed unless the unlock operation of the lock lever 30 (on-operation) is performed. However, in the case that damage of the locking mechanism etc. has caused the trigger 4 to be pulled while the lock lever 30 is not operated to be unlocked trigger lock state) (operational sequence D, E, F), it is all determined to be an error mode and the driving operation cannot be performed by the main body 2, and therefore, an erroneous operation of the trigger 4 can be reliably prevented, and furthermore an unintended driving operation of the main body 2 can be prevented.

Various modifications can be made to the embodiment described above. For example, the lock lever 30 is exemplified as a locking mechanism for restricting the pull operation of the trigger 4, a configuration in which a push button or a slide lever is used as a locking mechanism can be applied as well.

Further, the drive wheel 15 is exemplified which has the double structure including the inner wheel 15*a* and the outer wheel 15*b*, but the locking mechanism can also be applied to a driving mechanism having a drive wheel of an integral structure.

The invention claimed is:

1. An electric drive tool comprising a driver supporting base, on which a driver for striking a driven member is mounted, and a driving wheel rotated by an electric motor as a driving source, wherein a driving operation for the driven member is performed by converting a rotary movement of the driving wheel into a linear movement of the driver supporting base in order to move the driver in a striking direction, wherein the electric drive tool comprises:

a contact trip configured to be pressed against a driven material, into which the driven member is driven, so as to be moved upward;

a trigger pulled by a user;

a locking mechanism configured to restrict the pull operation of the trigger, the locking mechanism having a lock lever that includes an unlocking part and a locking part and also having a supporting shaft that rotatably supports the lock lever, the lock lever capable to be positioned at a first position and a second position by rotating the lock lever around the supporting shaft such that the pull operation of the trigger can be restricted with the locking part by positioning the lock lever at the first position and can be allowed through the unlocking part by positioning the lock lever at the second position;

a trip sensor that detects a movement of the contact trip;

a trigger sensor that detects a movement of the trigger;

a lock sensor that detects an operation of the locking mechanism; and a control unit that inputs signals output from the trip sensor, the trigger sensor, and the lock sensor; wherein:

the control unit controls the driving operation;

the driving operation is achieved by performing a first operation for moving the contact trip upward, a second operation for pulling the trigger, and a third operation for releasing the locking mechanism by rotating the lock lever to position the lock lever at the second position and to allow the trigger to be pulled through the unlocking part; and the control unit is programmed to switch an operating mode of the driving operation based on an operational sequence of the first operation and the third operation.

2. The electric drive tool according to claim 1, wherein the electric drive tool is configured such that the control unit is programmed to switch the operating mode based on an operational sequence of three operations including the second operation in addition to the first operation and the third operation.

3. The electric drive tool according to claim 1, wherein the electric drive tool is configured such that, for the operation once reset with regard to the operational sequence, the control unit is programmed to switch the operating mode based on the operational sequence, the order of which is traced back.

4. The electric drive tool according to claim 1, wherein the electric drive tool is configured such that the control unit is programmed to switch the operating mode based on the operational sequence performed from an initial state where at least the first operation and the second operation are reset with regard to the operating sequence.

5. The electric drive tool according to claim 1, wherein a single shot mode, in which the driving operation can be performed after at least the first operation and the second operation are once reset, a continuous shot mode, in which the driving operation can be continuously performed by repeating either one of the first operation or the second operation, and a non-operating mode, in which the driving operation cannot be performed, are set as switchable operating modes.

6. The electric drive tool according to claim 1, wherein for an operational sequence in which the second operation is performed prior to the third operation, an error mode, in which no driving operation is performed, is set.

7. The electric drive tool according to claim 2, wherein the electric drive tool is configured such that, for the operation once reset with regard to the operational sequence, the control unit is programmed to switch the operating mode based on the operational sequence, the order of which is traced back.

8. The electric drive tool according to claim 2, wherein the electric drive tool is configured such that the control unit is programmed to switch the operating mode based on the operational sequence performed from an initial state where at least the first operation and the second operation are reset with regard to the operating sequence.

9. The electric drive tool according to claim 1, wherein the contact trip and the locking mechanism are operable independently of each other.

* * * * *